US008600246B2

(12) United States Patent
Kurimoto

(10) Patent No.: US 8,600,246 B2
(45) Date of Patent: Dec. 3, 2013

(54) DEVELOPER RECOVERY DEVICE AND IMAGE FORMING APPARATUS INCLUDING SAME

(75) Inventor: Naoaki Kurimoto, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 286 days.

(21) Appl. No.: 13/151,468

(22) Filed: Jun. 2, 2011

(65) Prior Publication Data

US 2011/0318026 A1 Dec. 29, 2011

(30) Foreign Application Priority Data

Jun. 25, 2010 (JP) ..... 2010-144908
Jun. 25, 2010 (JP) ..... 2010-144909

(51) Int. Cl.
*G03G 21/12* (2006.01)
*G03G 21/00* (2006.01)

(52) U.S. Cl.
USPC ..... 399/35; 399/120; 399/167; 399/358; 399/360

(58) Field of Classification Search
USPC ..... 399/35, 120, 343, 358, 360
See application file for complete search history.

(56) References Cited

U.S. PATENT DOCUMENTS 5,339,145 A * 8/1994 Omura ..... 399/318
5,617,195 A 4/1997 Torimaru et al.
5,634,172 A 5/1997 Manabe
6,779,640 B2 8/2004 Tomita
7,188,718 B2 * 3/2007 Tomita et al. ..... 192/24
2003/0118368 A1 * 6/2003 Saito et al. ..... 399/111
2004/0040811 A1 3/2004 Tomita
2006/0193648 A1 * 8/2006 Kadowaki et al. ..... 399/13

FOREIGN PATENT DOCUMENTS

JP 02-064684 3/1990
JP 07-225538 8/1995
JP 8-129329 A 5/1996
JP 8-241020 9/1996
JP 2000-162945 6/2000
JP 2004-092887 3/2004
JP 2006-235382 A 9/2006
JP 2007-163764 6/2007
JP 2008-261968 10/2008
JP 2010-026276 2/2010

* cited by examiner

*Primary Examiner* — David Gray
*Assistant Examiner* — Francis Gray
(74) *Attorney, Agent, or Firm* — Renner, Otto, Boisselle & Sklar, LLP

(57) ABSTRACT

A developer recovery device is provided with a recovery container that receives and accommodates developer recovered from an image carrier, an agitator member that agitates the developer inside the recovery container, two shafts, to which mutually engageable cams are respectively provided, transmit rotational force to the agitator member, a spring that biases and causes to move one of the cams such that the two cams mutually engage and that causes a shaft connection between the two shafts to join, a torque limiter that carries out joining of the shaft connection, and disjoining of the shaft connection, in which the two cams are caused to move apart to disjoin the shaft connection, and a full-state determination portion that detects a shaft connection disjoined state and, based on the detected disjoined state, determines that the recovery container has become full of developer.

18 Claims, 11 Drawing Sheets

DEVELOPER RECOVERY DEVICE AND IMAGE FORMING APPARATUS INCLUDING SAME

CROSS-REFERENCE TO RELATED APPLICATIONS

This application claims priority under 35 U.S.C. §119(a) on Patent Applications No. 2010-144908 and No. 2010-144909, filed in Japan on Jun. 25, 2010, the entire contents of which are herein incorporated by reference.

BACKGROUND OF THE INVENTION

The present invention relates to developer recovery devices, which recover and accommodate developer that is residual on an image carrier, and to image forming apparatuses including the same.

Electrophotographic apparatuses are an example of this type of image forming apparatus. In image forming apparatuses of this type, an electrostatic latent image is formed on an image carrier, then the electrostatic latent image on the image carrier is developed using toner to form a toner image on the image carrier, the toner image is transferred from the image carrier to a recording paper, then the recording paper is subjected to heat and pressure to fix the toner image onto the recording paper.

Picture quality is reduced in this image forming apparatus if residual toner on the image carrier is left as it is, and therefore the apparatus may have a configuration in which residual toner on the image carrier is removed and recovered in a recovery container. Furthermore, it is configured such that when the recovery container becomes full of toner, this is detected and reported so as to advise replacement of the recovery container.

For example, in the developer recovery devices described in JP 2006-235382A (hereinafter referred to as Patent Document 1) and JP H8-129329A (hereinafter referred to as Patent Document 2), residual toner on a photosensitive drum or transfer belt is removed, and the removed toner is transported to a recovery container by a transport screw such that the removed toner is recovered in the recovery container.

An agitator member is provided in the recovery container and the toner is agitated by the agitator member. Furthermore, a torque limiter is provided at a shaft that transmits rotational force to the agitator member in the developer recovery device. In this developer recovery device, when the recovery container becomes full of toner and an overload is exerted on the agitator member such that the agitator member becomes unable to rotate, the torque limiter becomes disjoined. When the torque limiter becomes disjoined, this is detected and a full state (recovery container full state) is determined indicating that the recovery container has become full of toner.

In this regard, in Patent Documents 1 and 2, cams are provided in the torque limiter, and these cams engage with each other and are arranged on two shafts that transmit rotational force to the agitator member, and when an overload is exerted on the agitator member and the agitator member stops such that the rotation of one of the shafts stops, the cams slip and the shaft connection is disjoined. With this technique, the disjoining of the shaft connection is detected, thereby determining that the recovery container is in a full state.

With a torque limiter such as this, sometimes the engagement state between the cams becomes unstable when the load on the agitator member increases close to an overload, and the disjoined state of the shaft connection also becomes unstable. Furthermore, in Patent Document 1, the recovery container is determined to be in a full state immediately upon detection of disjoining of the shaft connection, and therefore sometimes this determination is made even though the recovery container is not sufficiently full, which is a false determination.

Accordingly, the present invention has been devised in consideration of the conventional problems described above, and it is an object thereof to provide a developer recovery device that is capable of accurately determining whether or not the recovery container is full of toner, and an image forming apparatus including the same.

SUMMARY OF THE INVENTION

In order to address these issues, a developer recovery device according to the present invention is provided with a recovery container that receives and accommodates a developer recovered from an image carrier, an agitator member that agitates the developer inside the recovery container, two shafts to which mutually engageable cams are respectively provided and that transmit rotational force to the agitator member, a spring that biases and causes to move one of the cams such that the two cams mutually engage and that causes a shaft connection between the two shafts to be joined, a torque limiter that carries out joining of the shaft connection, in which the two cams are caused to mutually engage to join the shaft connection, and disjoining of the shaft connection, in which the two cams are caused to move apart to disjoin the shaft connection, and a full-state determination portion that detects a disjoined state of the shaft connection and, based on the detected disjoined state, determines that the recovery container has become full of developer, wherein the torque limiter is constituted by the two cams and the spring, and in a disjoined state of the shaft connection, due to the torque limiter, the one cam is stopped and the other cam rotates such that the two cams repetitively engage and move apart, and the full-state determination portion is provided with a switch that turns on/off in response to the engaging and moving apart of the two cams and obtains an on-off period of the switch, and in a case where the on-off period is within a prescribed time range that is set in advance and has been repeated at least a prescribed number of times that is set in advance, determines that the recovery container has become full of developer.

With the present invention, the two cams mutually engage due to the spring, thereby causing a shaft connection of the two shafts to join. Thus, as long as the recovery container does not become full of developer and an overload is not exerted on the agitator member, the two cams engage to form a shaft connection, and rotational force is transmitted to the agitator member via the shafts such that the agitator member rotates. Furthermore, when the recovery container becomes full of developer and an overload is exerted on the agitator member such that the agitator member does not rotate and one of the shafts stops, the cams slip and the shaft connection is disjoined.

And, in a disjoined state of the shaft connection, while one of the cams stops and the other cam rotates, the two cams repetitively engage and move apart. Accordingly, the full-state determination portion obtains the on-off period of the switch that turns on/off in response to the engaging and moving apart of the two cams, and in a case where the on-off period is within a prescribed time range and has been repeated at least a prescribed times, determines that the recovery container has become full of developer. In this way, it can be accurately determined that the recovery container is full.

For example, when the load on the agitator member increases close to an overload such that the engagement state of the two cams of the torque limiter becomes unstable, the engaging and moving apart of the two cams repeats irregularly such that on-off period of the switch fluctuates wildly and departs from the prescribed time range, or the on-off periods within the prescribed time range are not repeated more than the prescribed number of times, and therefore it cannot be determined that the recovery container is in a full state. Furthermore, in a case where the switch or the like malfunctions, the on-off of the switch does not repeat and it cannot be determined that the recovery container is in a full state.

Furthermore, a developer recovery device according to the present invention is provided with a recovery container that receives and accommodates a developer recovered from an image carrier, an agitator member that agitates the developer inside the recovery container, two shafts to which mutually engageable cams are respectively provided and that transmit rotational force to the agitator member, a spring that biases and causes to move one of the cams such that the two cams mutually engage and that causes a shaft connection between the two shafts to be joined, a torque limiter that carries out joining of the shaft connection, in which the two cams are caused to mutually engage to join the shaft connection, and disjoining of the shaft connection, in which the two cams are caused to move apart to disjoin the shaft connection, and a full-state determination portion that detects a disjoined state of the shaft connection and, based on the detected disjoined state, determines that the recovery container has become full of developer, wherein the torque limiter is constituted by the two cams and the spring, and in a disjoined state of the shaft connection, due to the torque limiter, the one cam is stopped rotating and the other cam rotates such that the two cams repetitively engage and move apart, and the full-state determination portion is provided with a switch that turns on/off in response to the engaging and moving apart of the cams, obtains an on time of the switch and an off time of the switch, and in a case where the on time is within a first prescribed time range that is set in advance and the off time is within a second prescribed time range that is set in advance, determines that the recovery container has become full of developer.

In this way, the full-state determination portion obtains the on time and the off time of the switch that turns on/off in response to the engaging and moving apart of the two cams, and in a case where the on time is within the first prescribed time range and the off time is within the second prescribed time range, determines that the recovery container has become full of developer. In this way, it can be accurately determined that the recovery container is full.

For example, when the load on the agitator member increases close to an overload such that the engagement state of the two cams of the torque limiter becomes unstable, the engaging and moving apart of the two cams repeats irregularly such that the on time or the off time of the switch is too short or too long, and the on time departs from the first prescribed time range and the off time departs from the second prescribed time range, and therefore no determination is made that the recovery container is in a full state. Furthermore, also in a case where the switch or the like malfunctions, the on time or the off time of the switch becomes long and the on time or the off time departs from the first prescribed time range or the second prescribed time range, and therefore it cannot be determined that the recovery container is in a full state.

In this regard, in Patent Document 2, rotation of one of the shafts is detected by a sensor and a pulse signal outputted from the sensor in accordance with rotation of the one shaft is monitored, and the output number of the pulse signal per unit of time gradually decreases and when the pulse signal completely stops being outputted, it is determined that the recovery container is in a full state, and therefore sometimes false determinations naturally occurred. For example, the recovery container was determined to be in a full state when the pulse signal from the sensor stopped being outputted due to a malfunction or the like such that sometimes false determinations occurred.

In contrast to this, as described above, the present invention can also address this conventional problem as well, and is capable of accurately determining whether or not the recovery container is full of toner.

Furthermore, in the developer recovery device according to the present invention, the full-state determination portion, in rotationally driving the agitator member, when the switch changes to on or off and the on/off state after the change continues for at least a malfunction determination time that is set in advance, may determine that a malfunction has occurred.

In this case, if the recovery container is not full of developer, the two cams engage such that the shaft connection is joined and the agitator member continues to rotate, and therefore the switch does not change. Furthermore, when the recovery container becomes full of developer such that an overload is exerted on the agitator member and the agitator member stops rotating, the cams slip and while one cam stops the other cam rotates such that the two cams repetitively engage and move apart so that the on/off of the switch also repeats, and therefore there is no long continuation of either the on or off state. Accordingly, in rotationally driving the agitator member, when the switch changes to on or off and the on/off state after the change has continued for at least the malfunction determination time, it can be determined that a malfunction has occurred.

Further still, in the developer recovery device according to the present invention, the torque limiter may be constituted by a second rotation member that is integrally secured to the one cam and that rotates and moves together with the one cam, and the switch may turn on/off by detecting a position of the second rotation member.

Furthermore, in the developer recovery device according to the present invention, the second rotation member may be a gear and the gear may mesh with a gear provided on a shaft of the agitator member.

In this case, the second rotation member not only pushes against one end of the spring but also fulfills a function as a gear that transmits rotational force.

In this regard, in the conventional techniques described in Patent Documents 1 and 2, one end of the spring abuts against a frame or a wall surface. In this case, the one end of the spring strongly abuts against the frame or the wall surface due to the biasing force of the spring and it is difficult for it to rotate. In this state, when one of the shafts rotates, the spring becomes twisted and due to this twisting the biasing force of the spring fluctuates such that the overload of the agitator member also fluctuates when the shaft connection is disjoined. For this reason, the determination that the recovery container is in a full state becomes inaccurate and the replacements of the recovery container cannot be carried out properly.

For example, when the biasing force of the spring decreases, the shaft connection disjoins even though the recovery container is not in a full state and prior to the exertion of an overload to the agitator member, such that a determination is made that the recovery container is in a full state.

Furthermore, in a case where the frame or the wall surface has been formed by a synthetic resin or the like, the one end of the spring rotates while strongly abutting against the frame or the wall surface, thereby causing wear to the frame or the wall surface or producing noise.

It should be noted in regard to Patent Document 1 that although no abutment location can be specified for the one end of the spring from the specification and drawings, since it is necessary for the spring to be compressed, it is conceivable that the one end of the spring presses against a secured surface (a frame or a wall surface).

Accordingly, to also address these conventional problems as well, another developer recovery device according to the present invention is provided with a recovery container that receives and accommodates a developer recovered from an image carrier, an agitator member that agitates the developer inside the recovery container, two shafts to which mutually engageable cams are respectively provided and that transmit rotational force to the agitator member, a first rotation member that is integrally secured to the one cam and that rotates together with the one cam, a second rotation member that is positioned along a shaft of the first rotation member, which is provided with the one cam, and that rotates together with the one cam, a spring that is interposed between the first rotation member and the second rotation member, that biases and causes to move the one cam such that the two cams mutually engage, and that causes a shaft connection between the two shafts to be joined, a torque limiter that includes the two cams and the spring, and that carries out joining of the shaft connection, in which the two cams are caused to mutually engage to join the shaft connection, and disjoining of the shaft connection, in which the two cams are caused to move apart to disjoin the shaft connection, and a full-state determination portion that detects a disjoined state of the shaft connection and, based on the detected disjoined state, determines that the recovery container has become full of developer.

With the present invention it is possible to accurately determine whether or not the recovery container is full of toner.

Furthermore, with the present invention, a spring is squeezed between the first rotation member and the second rotation member such the first rotation member and the one cam are biased by the spring with respect to the second rotation member, and the two cams mutually engage so as to join a shaft connection of the two shafts. Thus, as long as the recovery container does not become full of developer and an overload is not exerted on the agitator member, the two cams engage to form a shaft connection, and rotational force is transmitted to the agitator member via the shafts such that the agitator member rotates. Furthermore, when the recovery container becomes full of developer and an overload is exerted on the agitator member such that the agitator member does not rotate, the cams slip resisting the biasing force of the spring and the shaft connection is disjoined.

Since the first rotation member and the second rotation member rotate together with the one cam, both ends of the spring squeezed therebetween also rotate such that there is no twisting of the spring and the biasing force of the spring is stabilized. For this reason, the overload of the agitator member when the shaft connection is disjoined in resistance to the biasing force of the spring becomes stabilized, and the determination of a full state of the recovery container becomes accurate based on the disjoined state of the shaft connection, thereby enabling replacement of the recovery container with proper timings.

Furthermore, no extra load is exerted on either the first rotation member or the second rotation member such that the durability of the device can be improved without causing wear to the first rotation member or the second rotation member.

Furthermore, in the developer recovery device according to the present invention, the second rotation member may be a gear and may mesh with a gear secured on a shaft of the agitator member.

In this case, the second rotation member not only pushes against one end of the spring but also fulfills a function as a gear that transmits rotational force.

Further still, in the developer recovery device according to the present invention, when a position of the first rotation member is detected at a time when the cams have slipped resisting the biasing force of the spring and the shaft connection has become disjoined, the full-state determination portion may determine that the recovery container has become full of developer.

When the recovery container has become full of developer, an overload is exerted on the agitator member and the cams slip resisting the biasing force of the spring, and the first rotation member moves together with the one cam. Thus, a position of the first rotation member is detected and based on the detected position, it is possible to determine that the recovery container has become full of developer.

Furthermore, in the developer recovery device according to the present invention, a shaft of the first rotation member may be provided with a claw, and a rib is formed in the first rotation member, a hole may be provided and a groove may be formed in the second rotation member, the shaft of the first rotation member may be inserted into the hole of the second rotation member so as to be movable, the claw of the shaft of the first rotation member may catch onto a peripheral edge of the hole of the second rotation member, and the rib of the first rotation member may engage with the groove of the second rotation member such that the first rotation member and the second rotation member rotate together. In this case, the shaft of the first rotation member is inserted into a central hole of the second rotation member so as to be movable, and the claw of the shaft of the first rotation member catches onto a peripheral edge of the central hole of the second rotation member, thereby preventing the second rotation member from coming off from the shaft of the first rotation member, and the rib of the first rotation member engages with the groove of the second rotation member so that the first rotation member and the second rotation member rotate together.

Further still, in the developer recovery device according to the present invention, the spring is a coil spring into which the shaft of the first rotation member is inserted.

On the other hand, an image forming apparatus according to the present invention is provided with a developer recovery device according to the present invention described above. Equivalent effects are also achieved in an image forming apparatus according to the present invention.

BRIEF DESCRIPTION OF THE DRAWINGS

FIG. 8 is constituted by FIG. 8A and FIG. 8B.

REFERENCE SIGNS LIST

Figure 1:
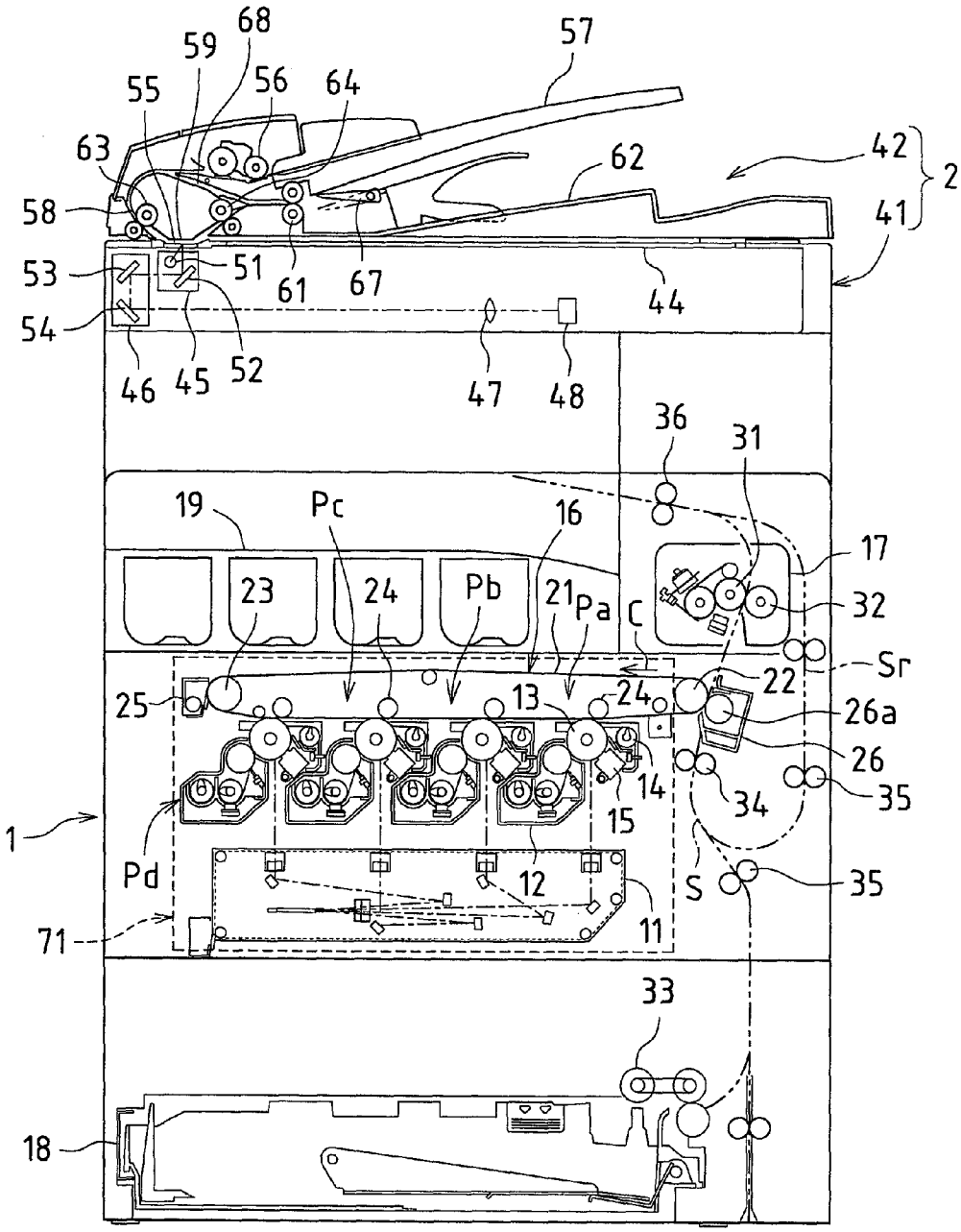
FIG. 1 is a cross-sectional view showing an image forming apparatus in which is applied one embodiment of a developer recovery device according to the present invention.

1 Image forming apparatus
2 Image reading device
11 Laser exposure device
12 Development device
13 Photosensitive drum
14 Drum cleaning device
15 Charger
16 Intermediate transfer belt device
17 Fixing device
18 Paper feed tray
19 Paper discharge tray
41 Reading scanner
42 Original transport device
77 Agitator blade
91 Movable lever portion
92 Output gear (second rotation member)
93 Input gear
94 Worm gear
95 Coupling gear
96 Coupling flange (first rotation member)
97 Coil spring
98 Switch
99 Knob
101 Frame
121 Control portion (full-state determination portion)
122 Display portion
UN Rotational drive unit

DESCRIPTION OF EMBODIMENTS

Hereinafter, embodiments of the present invention are described in detail with reference to the accompanying drawings.

FIG. 1 is a cross-sectional view showing an image forming apparatus in which is applied one embodiment of a developer recovery device according to the present invention. An image forming apparatus 1 is a so-called multifunction machine having functions such as a scanning function, a copying function, a printing function, and a fax machine function, and an image of an original that has been read by an image reading device 2 is transmitted externally (corresponding to the scanning function), then the image of this original that has been read by the image reading device 2, or an image that has been received from outside is recorded and formed on a recording paper in color or monochrome (corresponding to the copying function, printing function, and fax machine function). It should be noted that in FIG. 1, a position of a developer recovery device 71 in the image forming apparatus 1 is shown by a dashed line.

In order to print an image on a recording paper, the image forming apparatus 1 is provided with components such as a laser exposure device 11, development devices 12, photosensitive drums 13, drum cleaning devices 14, chargers 15, an intermediate transfer belt device 16, a fixing device 17, a paper transport path S, a paper feed tray 18, and a paper discharge tray 19.

The image data handled in the image forming apparatus 1 corresponds to color images using each of the colors black (K), cyan (C), magenta (M), and yellow (Y), or corresponds to a monochrome image using a single color (for example, black). Thus, four sets each of the development devices 12, the photosensitive drums 13, the drum cleaning devices 14, and the chargers 15 are provided to form four toner images corresponding to the four colors, with these being associated with black, cyan, magenta, and yellow respectively, thereby constituting four image stations Pa, Pb, Pc, and Pd.

Each of the photosensitive drums 3 in the image stations Pa, Pb, Pc, and Pd is provided with a photosensitive layer on its surface. Each of the chargers 15 is a charging means for uniformly charging the surface of its respective photosensitive drum 13 to a predetermined electric potential and in addition to contact types such as roller and brush charging units, charger-type chargers are also used.

The laser exposure device 11 is a laser scanning unit (LSU) provided with a laser diode and reflective mirrors, and this exposes the surface of each of the charged photosensitive drums 13 in response to image data such that an electrostatic latent image is formed on each of the surfaces corresponding to the image data.

Each of the development devices 12 develops the electrostatic latent image formed on the surface of its respective photosensitive drum 13 using one of the color toners, thereby forming toner images on the surfaces of the photosensitive drums 13. Each of the drum cleaning devices 14 removes and recovers toner that is residual on the surface of its respective photosensitive drum 13 after development and image transfer.

The intermediate transfer belt device 16 is positioned above the photosensitive drums 13, and is provided with an intermediate transfer belt 21, an intermediate transfer belt drive roller 22, an idler roller 23, four intermediate transfer rollers 24, and a belt cleaning device 25.

The intermediate transfer belt 21 is a film formed in an endless belt shape. The intermediate transfer belt 21 spans in a tensioned state and is supported by the intermediate transfer belt drive roller 22, the idler roller 23, and intermediate transfer rollers 24. The intermediate transfer belt 21 is caused to move there-around in a direction of arrow C.

Each of the intermediate transfer rollers 24 is rotatably supported near the intermediate transfer belt 21, and presses against its respective photosensitive drum 13 through the intermediate transfer belt 21. The toner image on the surface of each of the photosensitive drums 13 is superimposed and transferred in order onto the intermediate transfer belt 21, thereby forming a color toner image (a toner image having each of these colors) on the intermediate transfer belt 21. Transfer of the toner image from each of the photosensitive drums 13 to the intermediate transfer belt 21 is carried out by each of the intermediate transfer rollers 24 that press against the rear surface of the intermediate transfer belt 21. Each of the intermediate transfer rollers 24 is a roller in which a metal shaft (for example stainless steel) is used as a core and the surface thereof is covered by a conductive elastic material (for example, EPDM or urethane foam or the like). A high voltage transfer bias (a high voltage that has opposite polarity (+) to the charge polarity (−) of the toner) is applied to each of the intermediate transfer rollers 24 to achieve transfer of the toner images, and the high voltage is applied uniformly to the recording paper due to the conductivity of the elastic material.

Thus, the toner image on the surface of each of the photosensitive drums 13 is transferred and layered onto the intermediate transfer belt 21 to become a color toner image indicated by the image data. This color toner image is transported together with the intermediate transfer belt 21 then transferred onto a recording paper at a nip region between the intermediate transfer belt 21 and a transfer roller 26*a* of a secondary transfer device 26.

A voltage (a high voltage that has an opposite polarity (+) to the charge polarity (−) of the toner) is applied to the transfer roller 26*a* of the secondary transfer device 26 in order for the color toner image on the intermediate transfer belt 21 to be transferred to the recording paper.

In this regard, sometimes the toner images on the intermediate transfer belt 21 are not completely transferred onto the recording paper by the secondary transfer device 26 such that some toner becomes residual on the surface of the intermediate transfer belt 21, and this residual toner is a cause of toner colors becoming mixed undesirably at subsequent steps. In order to address this problem, the belt cleaning device 25 is provided in the image forming apparatus 1 and the residual toner on the surface of the intermediate transfer belt 21 is removed and recovered by the belt cleaning device 25. In the belt cleaning device 25, a cleaning blade is provided for example as a cleaning member that contacts the surface of the intermediate transfer belt 21 and removes residual toner, and the rear side of the intermediate transfer belt 21 is supported by the idler roller 23 at a position where the cleaning blade contacts the intermediate transfer belt 21.

After the color (or monochrome) toner image has been transferred at the nip region between the intermediate transfer belt 21 and the transfer roller 26*a* of the secondary transfer device 26, the recording paper is transported to the fixing device 17. The fixing device 17 is provided with components such as a heating roller 31 and a pressure roller 32, and the recording paper is transported sandwiched between the heating roller 31 and the pressure roller.

The heating roller 31 is controlled based on detection output from an unshown temperature detector so as to reach a predetermined fixing temperature, and melts, mixes, and presses the color toner image that has been transferred onto the recording paper to thermally fix it to the recording paper by applying thermocompression to the recording paper along with the pressure roller 32.

Furthermore, a paper feed tray 18 that supplies recording papers is provided at a lower portion of the image forming apparatus 1. A paper transport path S is provided in the image forming apparatus 1 for sending the recording paper supplied from the paper feeding tray 18 to the paper discharge tray 19 via the secondary transfer device 26 and the fixing device 17.

A paper pickup roller 33 is provided at an end portion of the paper feed tray 18, and recording papers are withdrawn sheet by sheet from the paper feed tray 18 by this paper pickup roller 33 to be transported to the paper transport path S.

Arranged along the paper transport path S (which also includes a reverse path Sr) are components such as paper registration rollers 34, the fixing device 17, transport rollers 35, and discharge rollers 36. The transport rollers 35 are small-size rollers for facilitating and assisting the transport of the recording papers, and a plurality of pairs of these are provided.

The paper registration rollers 34 provide well timed transport of the recording papers by temporarily stopping the recording paper that has been transported in and aligning the leading edge of the recording paper, then the rotations of each of the photosensitive drums 13 and the intermediate transfer belt 21 are matched so that the (color) toner image on the intermediate transfer belt 21 is transferred onto the recording paper at the nip region between the intermediate transfer belt 21 and the transfer roller 26*a* of the secondary transfer device 26.

It should be noted that the color toner image is fixed by the fixing device 17 onto the recording paper that is transported by the paper registration rollers 34 and passes through the fixing device 17. Then, the recording paper on which the toner image has been fixed by the fixing device 17 is discharged face down on the paper discharge tray 19 by the discharge rollers 36.

Furthermore, in a case of carrying out printing not only on the front side of the recording paper but on the rear side as well, the discharge rollers 36 are caused to pause midway during transport of the recording paper by the discharge rollers 36 then to rotate in reverse such that the front and rear of the recording paper are inverted by passing through the reverse path Sr, then the recording paper is guided to the paper registration rollers 34 and, in a same manner as the front side of the recording paper, an image is recorded by a toner image being transferred to the rear side of the recording paper, after which the image is fixed to the recording paper then discharged to the paper discharge tray 19.

Next, description is given regarding the image reading device 2, which is mounted on an upper portion of the main unit of the image forming apparatus 1. The image reading device 2 is provided with a reading scanner 41 of a lower side and an original transport device 42 of an upper side. One inner side of the original transport device 42 of the upper side is pivotably supported by a hinge (not shown in drawings) on one inner side of the reading scanner 41 of the lower side, and a front area of the original transport device 42 can be opened and closed by being raised or lowered. When the original transport device 42 is open, a platen glass 44 of the reading scanner 41 is uncovered. An original is placed on this platen glass 44.

The reading scanner 41 is provided with components such as the platen glass 44, a first scanning unit 45, a second scanning unit 46, an imaging lens 47, and a CCD (charge coupled device) 48. While the first scanning unit 45, which is provided with an illumination device 51 and a first reflective mirror 52, moves in a sub scanning direction Y at a constant velocity V for a distance corresponding to the size of the original, the original on the platen glass 44 is exposed to light by the illumination device 51, and the reflected light thereof is reflected by the first reflective mirror 52 and guided to the second scanning unit 46, and in this way an image of the surface of the original is scanned in the sub scanning direction. While the second scanning unit 46, which is provided with second and third reflective mirrors 53 and 54, moves at a velocity V/2 following the first scanning unit 45, the reflected light from the original is reflected by the second and third reflective mirrors 53 and 54 and guided to the imaging lens 47. The imaging lens 47 focuses the reflected light from the original onto the CCD 48 such that an image of the surface of the original is formed on the CCD 48. The CCD 48 repetitively scans the image of the original in the main scanning direction and at each scan it outputs analog image signals of one main scanning line.

Furthermore, the reading scanner 41 is also capable of reading not only stationary originals, but also capable of reading an image of the surface of an original that is being transported by the original transport device 42. In this case, the first scanning unit 45 is caused to move in a reading range below an original reading glass 55, and the second scanning unit 46 is positioned in response to the position of the first scanning unit 45, then in this state, transport commences of the original by the original transport device 42.

In the original transport device 42, a pickup roller 56 presses against an original at the top of an original tray 57 and rotates, thereby pulling the original into an original transport path 58. Then, the original transported on the original transport path 58 passes between the original reading glass 55 and a reading guide panel 59, then the original is further transported from a discharge roller 61 to a discharge tray 62. It should be noted that in this original transport device 42, registration rollers 63, which align a leading edge of the original for transport, and transport rollers 64, which transport the original, are arranged along the original transport path 58.

Furthermore, during the transport of this original, the surface of the original is illuminated through the original reading glass 55 by the illumination device 51 of the first scanning unit 45, and reflected light from the surface of the original is guided to the imaging lens 47 by the reflective mirrors of the first and second scanning units 45 and 46, then the reflected light from the surface of the original is focused on the CCD 48 by the imaging lens 47 such that an image of the surface of the original is formed on the CCD 48, and in this way an image of the surface of the original is read.

Furthermore, in a case of reading the rear surface of the original, an intermediate tray 67 rotates on its shaft as shown by the dotted line (see FIG. 1), then midway while the original is being discharged by the discharge rollers 61 to the discharge tray 62, the discharge rollers 61 are caused to stop, then the original is received on the intermediate tray 67 and the discharge rollers 61 are caused to rotate in reverse such that the original is guided to the registration rollers 63 via the reverse transport path 68, thereby reversing the front and back of the original, then an image of the rear surface of the original is read in a same manner as the image of the front surface of the original, and the intermediate tray returns to its original position as shown by the solid line (see FIG. 1), and the original is discharged from the discharge rollers 61 to the discharge tray 62.

The image of the original that has been read by the CCD 48 in this manner is outputted as analog image signals from the CCD 48, and these analog image signals undergo A/D conversion to digital image signals (image data). Then, this image data is sent to the laser exposure device 11 of the image forming apparatus 1 after undergoing various types of image processing, and the image is recorded onto a recording paper using an image forming portion constituted by the laser exposure device 11 that has obtained (received) the image data, and the image stations Pa, Pb, Pc, and Pd, then the recording paper is outputted as a reproduced original.

On the other hand, as described above, in the image forming apparatus 1, the residual toner on the surface of each of the photosensitive drums 13 is removed by the respective drum cleaning device 14, and the residual toner on the surface of the intermediate transfer belt 21 is removed by the belt cleaning device 25. The toner that is removed by these cleaning devices 14 and 25 is transported to the developer recovery device 71 (see below) according to the present embodiment, then collected and accommodated in the developer recovery device 71.

Figure 2:
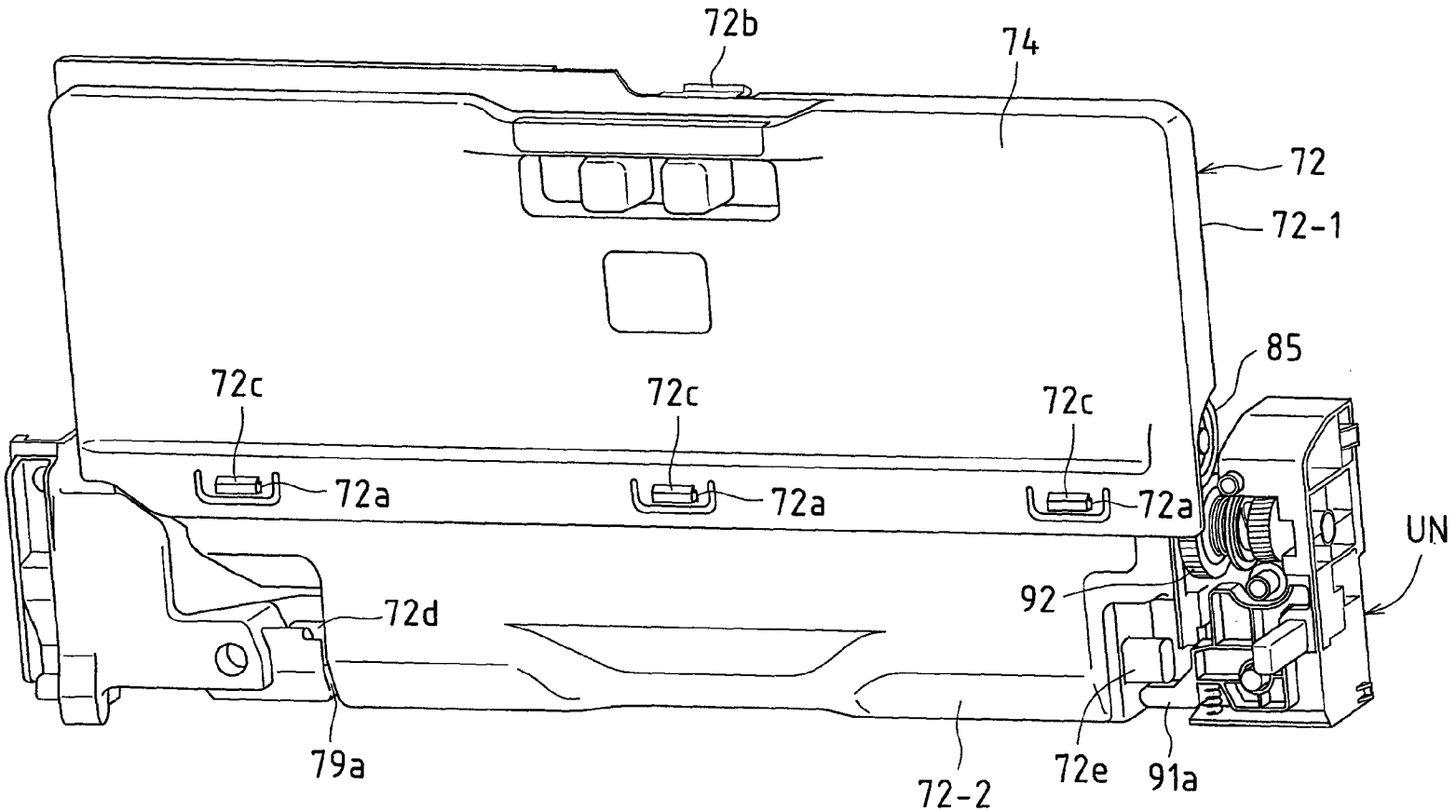
FIG. 2 is a perspective view showing a toner recover container and a rotational drive unit in the developer recovery device as viewed from the front side of the image forming apparatus.
Figure 3:
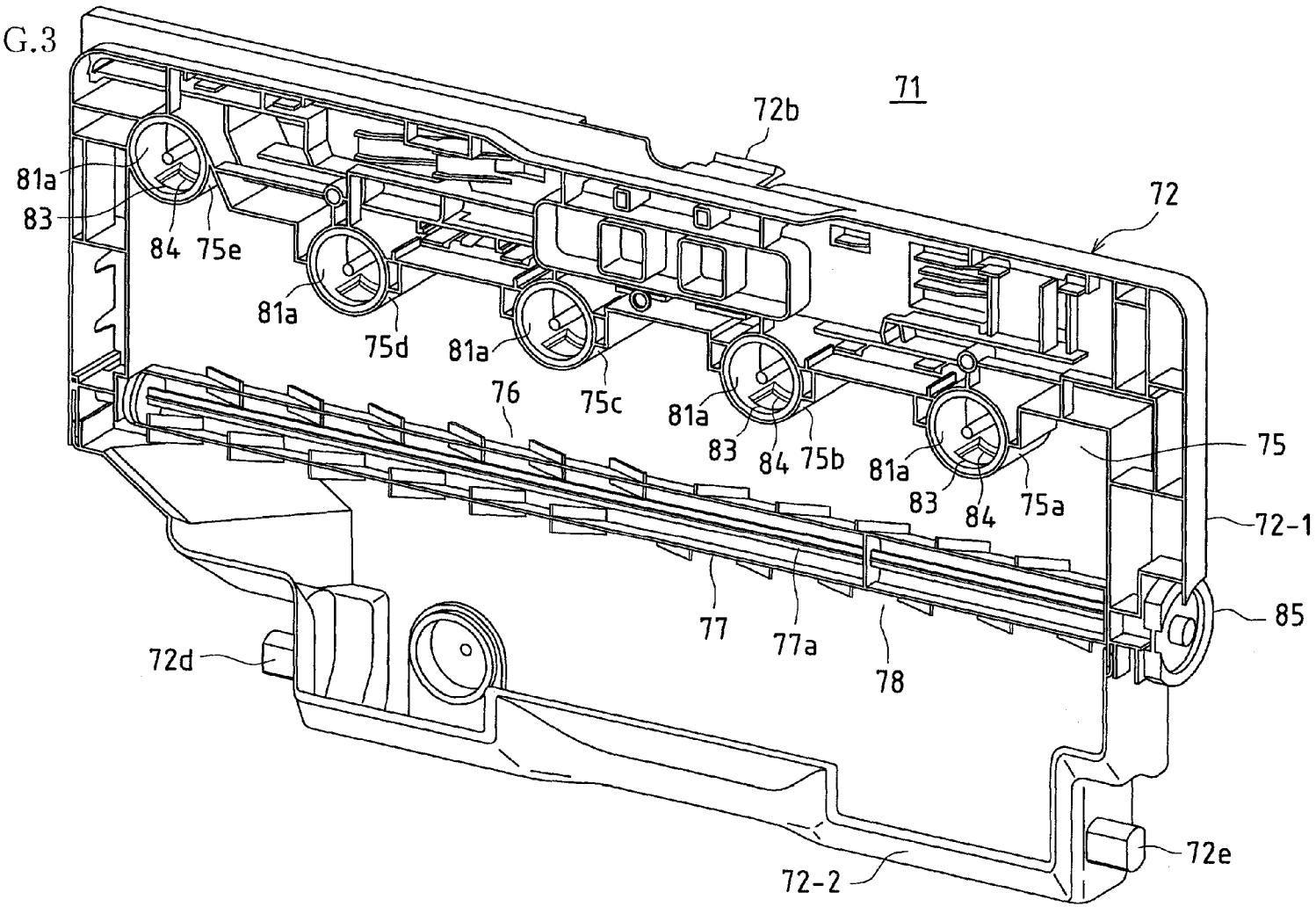
FIG. 3 is a vertical cross-sectional view of the toner recovery container in the developer recovery device as viewed from the front side of the image forming apparatus, and shows an internal structure of a rear area side.

FIG. 2 is a perspective view showing a toner recovery container 72 and a rotational drive unit UN (see below) in the developer recovery device 71 according to the present embodiment as viewed from the front side of the image forming apparatus 1. Furthermore, FIG. 3 is a vertical cross-sectional view of the toner recovery container 72 in the developer recovery device 71 as viewed from the front side of the image forming apparatus 1, and shows an internal structure of a rear area side. Furthermore, FIG. 4 is a cross-sectional view showing the toner recovery container 72 and a toner recovery portion 73 provided in each of the cleaning devices 14 and 25 in the developer recovery device 71.

Figure 4:
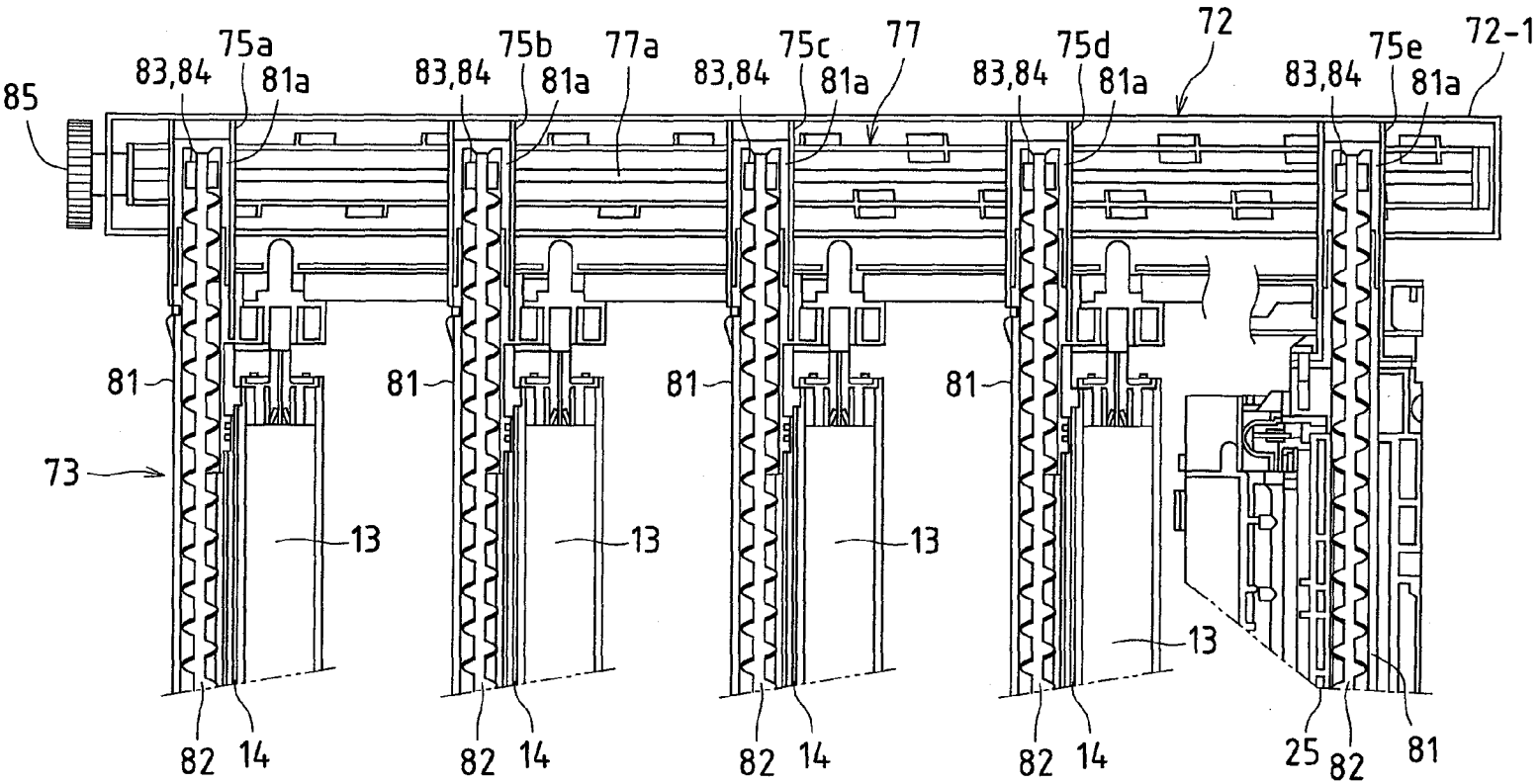
FIG. 4 is a cross-sectional view showing the toner recovery container and a toner recovery portion provided in each of the cleaning devices in the developer recovery device.

As shown in FIG. 1, the developer recovery device 71 according to the present embodiment is arranged near the cleaning devices 14 and 25, and as shown in FIGS. 2 to 4, is provided with the image forming toner recovery container 72, toner recovery portions 73, and the rotational drive unit UN.

The toner recovery container 72 is arranged in a near side (front side) space inside in the image forming apparatus 1, and is provided with an upper side container 72-1 and a lower side container 72-2. The upper side container 72-1 is connected to the toner recovery portions 73 (see FIG. 4) arranged on the side of the cleaning devices 14 and 25, and toner that is transported in by each of the toner recovery portions 73 is introduced and received here. The lower side container 72-2 accommodates the toner that has been introduced to the upper side container 72-1.

The upper side container 72-1 is a housing having a near side wall portion 74, a rear surface side wall portion 75, and a bottom side opening portion 76, and agitator blades 77 are arranged at the bottom side opening portion 76. The lower side container 72-2 is a housing that mounts to the bottom side of the upper side container 72-1 and is provided with an upper side opening portion 78.

As shown in FIG. 2, multiple coupling holes 72*a* are formed at an outer circumferential lower side of the upper side container 72-1, and multiple claws 72*c* are formed at an outer circumferential upper side of the lower side container 72-2. In regard to the upper side container 72-1 and the lower side container 72-2, the upper side opening portion 78 of the lower side container 72-2 fits into an inner side of the bottom side opening portion 76 of the upper side container 72-1, and the claws 72*c* of the lower side container 72-2 engage into the coupling holes 72*a* of the upper side container 72-1 respectively such that the lower side container 72-2 mounts into the bottom side of the upper side container 72-1.

Furthermore, as shown in FIGS. 2 and 3, a hook 72*b* is formed at a rear surface upper side of the upper side container 72-1, and protruding portions 72*d* and 72*e* are formed at bottom side ends of the lower side container 72-2. The lower side container 72-2 is placed on a frame (not shown in drawings) of the image forming apparatus 1 such that, as shown in FIG. 2, the protruding portion 72*d* on the bottom side left end of the lower side container 72-2 fits into a recess 79*a* of an attachment member 79 of the image forming apparatus 1, and the hook 72*b* of the rear surface upper side of the upper side container 72-1 engages with an engaging portion (not shown in drawings) of the frame of the image forming apparatus 1 such that the toner recovery container 72 mounts to the image forming apparatus 1.

As shown in FIG. 2, in a state in which the toner recovery container 72 is mounted, the protruding portion 72*e* of the bottom side right end of the lower side container 72-2 is placed on a lever 91*a* of the rotational drive unit UN, which is provided on the image forming apparatus 1 side, thereby pressing down on the lever 91*a*. Furthermore, as shown in FIG. 4, the toner recovery portions 73, which are arranged on the side of each of the cleaning devices 14 and 25, are connected at the rear surface of the upper side container 72-1.

Here, as shown in FIGS. 3 and 4, four tubular introduction portions 75*a*, 75*b*, 75*c*, and 75*d* and one tubular introduction portion 75*e* are formed at the rear surface side wall portion 75 of the upper side container 72-1. Furthermore, the toner recovery portions 73 on the side of the cleaning devices 14 and 25 are provided with a transport screw 82, and the transport screw 82 is arranged inside each of multiple conduit tubes 81. To describe in further detail the relationships between the upper side container 72-1 and the toner recovery portions 73, an end portion 81*a* of each of the conduit tubes 81 of the toner recovery portions 73 on the side of the cleaning devices 14 and 25 is inserted into the tubular introduction portions 75*a* to 75*e* of the rear surface side wall portion 75 of the upper side container 72-1 such that the toner recovery portions 73 on the side of the cleaning devices 14 and 25 are connected at the rear surface of the upper side container 72-1.

The four tubular introduction portions 75*a* to 75*d* correspond to the cleaning devices 14 that perform cleaning respectively on each of the photosensitive drums 13, which form toner images in four colors, and the end portions 81*a* of the conduit tubes 81 of the toner recovery portions 73 on the side of each of the cleaning devices 14 is inserted into these tubular introduction portions 75*a* to 75*d*. The conduit tubes 81 of the toner recovery portions 73 are arranged along the lengthwise direction of the photosensitive drums 13 respectively, and are provided with open slits (not shown in drawings) along this lengthwise direction. The toner that is removed from the surface of the each of the photosensitive drums 13 by a blade or the like of the cleaning devices 14 is disposed respectively into the conduit tubes 81 via these open slits. Each of the transport screws 82 is rotationally driven in one direction inside its respective conduit tube 81, and the toner inside each of these conduit tubes 81 is transported (drawn out) in the direction of the tubular introduction portions 75*a* to 75*d* of the upper side container 72-1.

Furthermore, the single tubular introduction portions 75*e* corresponds to the cleaning device 25 that performs cleaning on the intermediate transfer belt 21, which transfers the toner images of four colors, and the end portion 81*a* of the conduit tube 81 of the toner recovery portion 73 on the side of the cleaning device 25 is inserted into the tubular introduction portion 75*e*. The conduit tube 81 of this toner recovery portion 73 is arranged along the main scanning direction of the intermediate transfer belt 21, and is provided with open slits (not shown in drawings) along this main scanning direction. The toner that is removed from the surface of the intermediate transfer belt 21 by a blade or the like of the cleaning device 25 is disposed into the conduit tube 81 via these open slits. The transport screw 82 is rotationally driven in one direction inside the conduit tube 81, and the toner inside the conduit tube 81 is transported (drawn out) in the direction of the tubular introduction portion 75*e* of the upper side container 72-1.

Inside each of the tubular introduction portions 75*a* to 75*e*, the end portion 81*a* of each of the conduit tubes 81 is rotatable, and a disposal hole 83 is formed in a lateral wall of each of the end portions 81*a* respectively, while the end surface of each of the end portions 81*a* is closed. Furthermore, a disposal hole 84 is formed in the lateral wall of each of the tubular introduction portions 75*a* to 75*e* respectively. In a state in which the end portion 81*a* of each of the conduit tubes 81 is rotated such the disposal hole 83 of the end portion 81*a* of each of the conduit tubes 81 is superimposed on the disposal hole 84 of each of the tubular introduction portions 75*a* to 75*e* respectively, the toner that is transported in by its respective transport screw 82 is discharged to the upper side container 72-1 through the discharge holes 83 and 84, and this toner drops and is accommodated inside the lower side container 72-2 via the bottom side opening portion 76 of the upper side container 72-1 and the upper side opening portion 78 of the lower side container 72-2.

Furthermore, in a state in which the end portion 81*a* of each of the conduit tubes 81 is rotated such that the disposal hole 83 of the end portion 81*a* of each of the conduit tubes 81 is displaced from the disposal hole 84 of each of the tubular introduction portions 75*a* to 75*e*, the toner inside each of the conduit tubes 81 does not discharge through the disposal holes 83 and 84. In this state, the upper side container 72-1 or the lower side container 72-2 is replaced.

As shown in FIGS. 3 and 4, the agitator blades 77 are axially supported so as to be rotatably on a shaft 77*a* that spans across the bottom side opening portion 76 of the upper side container 72-1, and a gear 85 that is secured at one end of the shaft 77*a* meshes with an output gear 92 of the rotational drive unit UN. The gear 85 is rotationally driven by the rotational drive unit UN, and the shaft 77*a* rotates due to this rotational drive through the gear 85. Due to the rotation of the shaft 77*a*, the agitator blades 77 agitate and spread the toner that has dropped down from the disposal hole 84 of each of the tubular introduction portions 75*a* to 75*e*, thereby making uniform the height of the surface of the toner collected in the bottom of the lower side container 72-2.

It should be noted that the transport screw 82 inside each of the conduit tubes 81 is rotationally driven by a power source on the cleaning devices 14 and 25 side. Furthermore, although a mechanism for rotating the end portion 81*a* of each of the conduit tubes 81 is not shown, the end portion 81*a* of each of the conduit tubes 81 is rotated manually.

Figure 5:
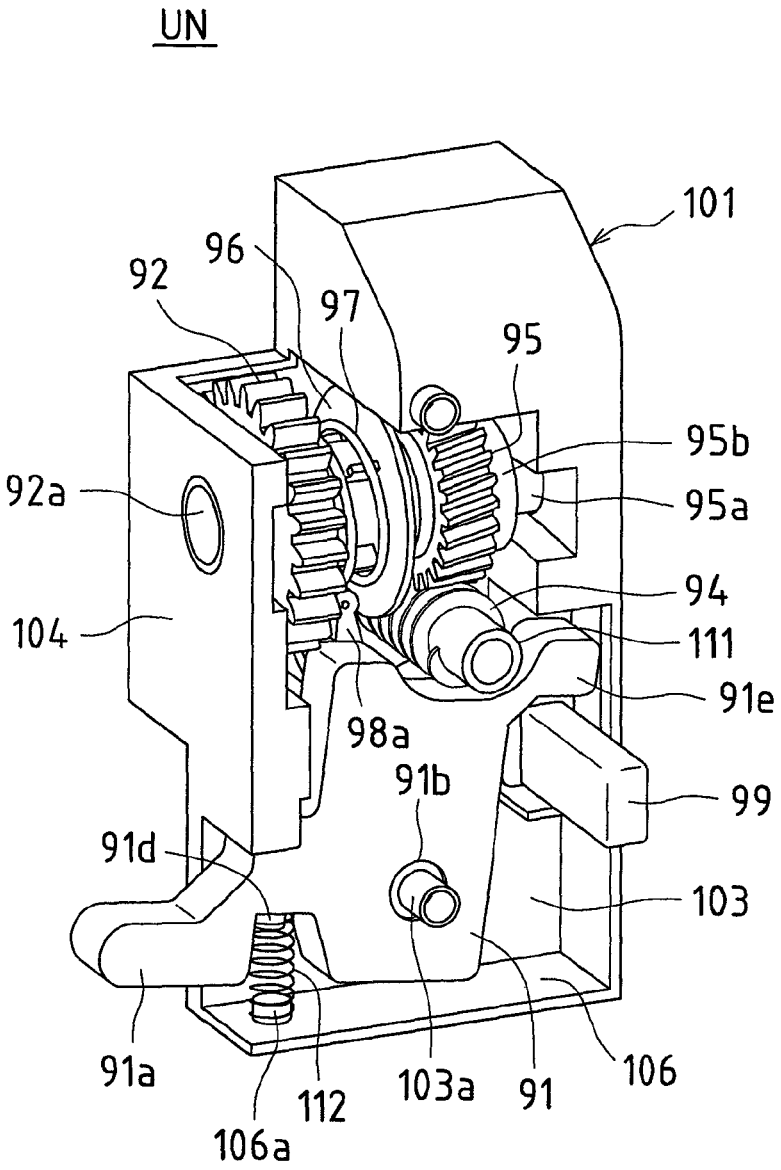
FIG. 5 is a perspective view showing a rotational drive unit in the developer recovery device as viewed from the front side.
Figure 6:
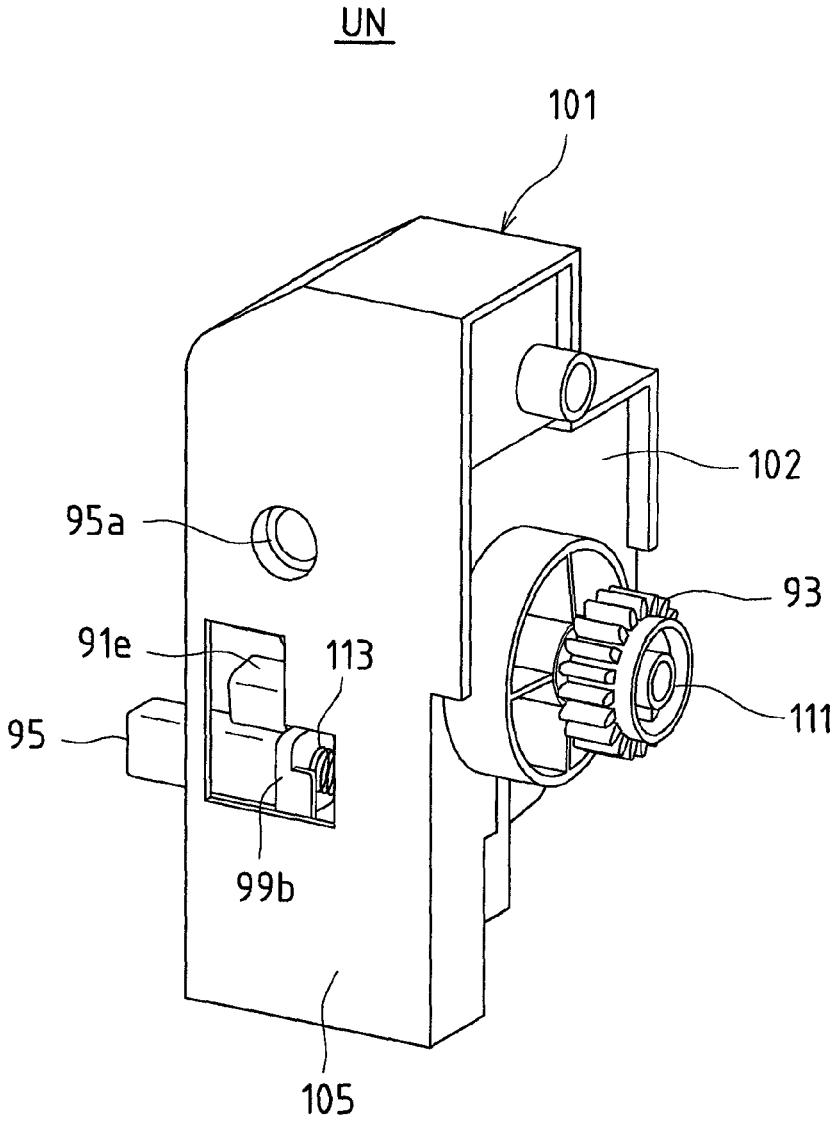
FIG. 6 is a perspective view showing the rotational drive unit in the developer recovery device as viewed from the rear.

Next, detailed description is given regarding the rotational drive unit UN. FIGS. 5 and 6 are perspective views of the rotational drive unit UN, as viewed from the front and as viewed from behind. Furthermore, FIG. 7 is a front view showing the rotational drive unit UN.

Figure 7:
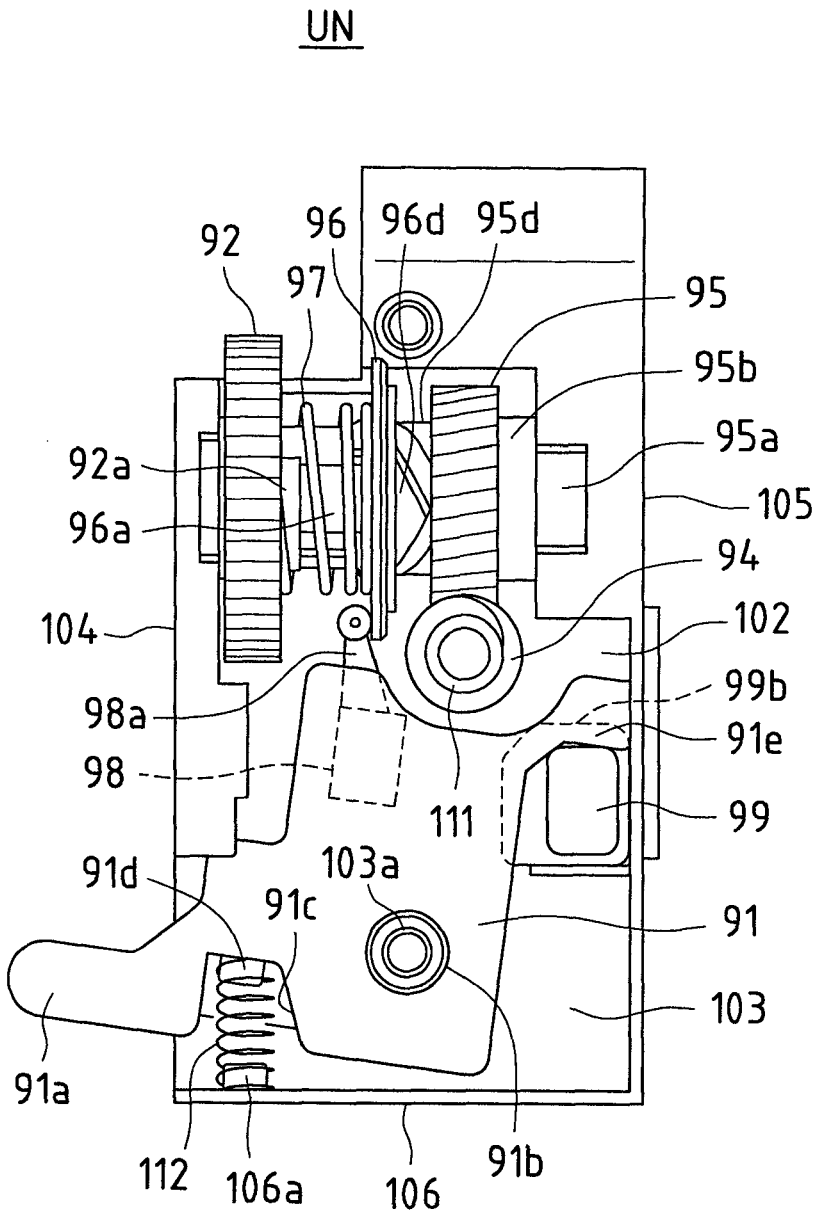
FIG. 7 is a front view showing the rotational drive unit in the developer recovery device.

As shown in FIGS. 5 to 7, the rotational drive unit UN is provided with components such as a movable lever portion 91, the output gear (second rotation member) 92, an input gear 93, a worm gear 94, a coupling gear 95, a coupling flange (first rotation member) 96, a coil spring 97, a switch 98, a knob 99, and a frame 101.

The frame 101 is provided with a central upper side wall portion 102, a central lower side wall portion 103, and two lateral wall portions 104 and 105, and a bottom portion 106.

A shaft hole 91*b* is formed in the movable lever portion 91, and a shaft 103*a* of the central lower side wall portion 103 of the frame 101 passes through the shaft hole 91*b* such that the movable lever portion 91 is supported so as to be rotatable around the shaft 103*a*. As shown in FIG. 5 and FIG. 7, a protrusion 91*d* is formed in a recess 91*c* of the movable lever portion 91. Ends of a coil spring 112 are fitted into the protrusion 91*d* of the movable lever portion 91 and a protrusion 106*a* of the bottom portion 106 of the frame 101. The coil spring 112 is pressed by the movable lever portion 91, and due to this compressed coil spring 112, the movable lever portion 91 is biased in a clockwise direction (upward direction in FIG. 7) centered on the shaft 103*a*.

Furthermore, as shown in FIG. 5 and FIG. 7, the switch 98 is secured at one surface of the movable lever portion 91 (the rear surface side wall portion), and a movable piece 98*a* of the switch 98 protrudes upward. The switch 98 has a spring (not shown in drawings) that biases the movable piece 98*a* rightward (one direction) and due to the spring, the switch 98 is off when the movable piece 98*a* is displaced rightward (one direction) and is on when the movable piece 98*a* resists the biasing force of the spring to be displaced leftward (other direction, which is a direction opposite to the one direction). In FIG. 7, the switch 98 is on.

As shown in FIG. 6, the knob 99 is biased by a coil spring 113 so that the knob 99 protrudes outward from the central lower side wall portion 103 to the near side of the paper plane.

In FIGS. 5 to 7, the knob 99 is resisting the biasing force of the coil spring 113 and is pushing to the central lower side wall portion 103 side. This is related to the fact that an engaging portion 91*e* of the movable lever portion 91 has shifted from a horizontal state to the central lower side wall portion 103 side by rotating clockwise centered on the shaft 103*a*. In this way, the movable lever portion 91 rotates in the clockwise direction (upward direction in FIG. 7) until the engaging portion 91*e* of the movable lever portion 91 contacts the outer circumference of the knob 99, and therefore the lever 91*a* of the movable lever portion 91 is held up as shown in FIG. 7. Furthermore, at this time, the movable piece 98*a* of the switch 98 contacts the coupling flange 96 and displaces leftward (other direction) such that the switch 98 becomes on.

As shown in FIGS. 5 to 7, the input gear 93 and the worm gear 94 are secured to ends of a shaft 111. The shaft 111 passes through a shaft hole (not shown in drawings) of the central upper side wall portion 102 of the frame 101 to axially support both the input gear 93 and the worm gear 94, and the worm gear 94 meshes with the coupling gear 95.

The output gear 92, the coupling gear 95, and the coupling flange 96 share a common shaft (shaft center) and engage with each other (for example, see FIG. 8). The coil spring 97 is compressed and interposed between the output gear 92 and the coupling flange 96.

As shown in FIG. 5, FIG. 7, and FIG. 8, the output gear 92 is provided with a tubular shaft 92*a*, and this tubular shaft 92*a* is inserted into a shaft hole of the lateral wall portion 104 and is supported so as to be readily rotatable. Furthermore, the output gear 92 presses against the lateral wall portion 104, and the axial direction of the output gear 92 is determined by this pressing, thereby positioning the output gear 92.

As shown in FIG. 5, FIG. 7, and FIG. 8, the coupling gear 95 is provided with a tubular shaft 95*a*, and this tubular shaft 95*a* is inserted into a shaft hole of the lateral wall portion 105 and is supported so as to be readily rotatable. Furthermore, a convex portion 95*b* of the coupling gear 95 presses against the lateral wall portion 105, and the axial direction of the coupling gear 95 is determined by this pressing, thereby positioning the coupling gear 95.

As shown in FIG. 5, FIG. 7, and FIG. 8, respective ends of the shaft of the coupling flange 96 are inserted into and are supported by the shaft hole of the output gear 92 and the shaft hole of the coupling gear 95. The coupling flange 96 rotates together with the output gear 92 and is capable of moving in the axial direction with respect to the output gear 92.

Figure 8A:
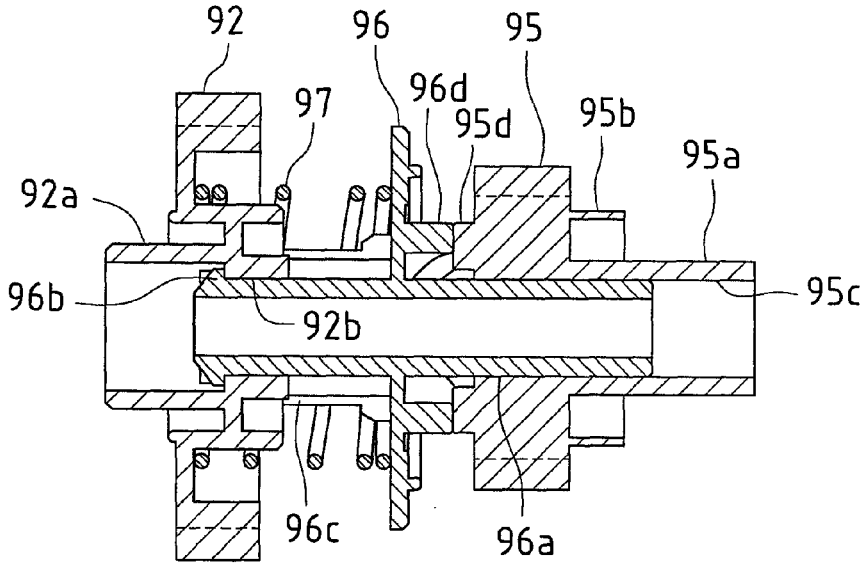
FIG. 8A is a cross-sectional view showing an enlargement of an output gear, a coupling gear, a coupling flange, and a coil spring in the rotational drive unit.
Figure 8B:
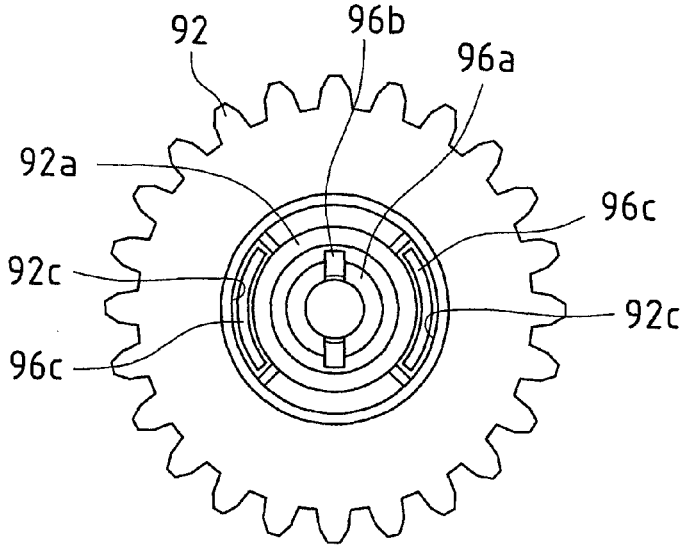
FIG. 8B is a top view showing the output gear and other components.

FIG. 8A is a cross-sectional view showing an enlargement of the output gear 92, the coupling gear 95, the coupling flange 96, and the coil spring 97. FIG. 8B is a top view showing the output gear 92 and other components.

As is evident from FIG. 8A and FIG. 8B, a shaft 96*a* is provided in the center of the coupling flange 96, the left side of the shaft 96*a* (side where the output gear 92 is positioned) is inserted into a shaft hole 92*b* of the output gear 92 so as to be readily movable, and a claw 96*b* on the left end of the shaft 96*a* catches onto a peripheral edge of the shaft hole 92*b* of the output gear 92.

The coupling flange 96 is capable of moving in a left direction in which the claw 96*b* of the shaft 96*a* moves apart from the peripheral edge of the shaft hole 92*b* of the output gear 92, and is capable of moving in a right direction until the claw 96*b* of the shaft 96*a* catches onto the peripheral edge of the shaft hole 92*b* of the output gear 92, and moves together with the shaft 96*a*. Furthermore, due to the claw 96*b* of the shaft 96*a* of the coupling flange 96, the output gear 92 is prevented from coming off the shaft 96*a*.

Furthermore, a pair of curved guide ribs 96*c*, which are provided protruding at the left side lateral surface of the coupling flange 96, are inserted into a pair of curved grooves 92*c* that are formed around the shaft hole 92*b* of the output gear 92. Due to the engaging of these curved guide ribs 96*c* and curved grooves 92*c*, the coupling flange 96 and the output gear 92 rotate together.

Further still, the right side of the shaft 96*a* of the coupling flange 96 (the side where the coupling gear 95 is positioned) is inserted into a shaft hole 95*c* of the coupling gear 95 so as to be readily movable and readily rotatable.

The coil spring 97 compresses and is inserted between the coupling flange (first rotation member) 96 and the output gear (second rotation member) 92. Due to the coil spring 97, the output gear 92 is biased to the left direction along the shaft 96*a* of the coupling flange 96 and presses against the lateral wall portion 104 (shown in FIG. 7) to be positioned. Furthermore, due to the coil spring 97, the coupling flange 96 is biased to the right direction along the shaft 96*a* of the coupling flange 96 along with the coupling gear 95 such that the coupling gear 95 presses against the lateral wall portion 105 (shown in FIG. 7) to be positioned.

Furthermore, the coil spring 97 biases the coupling flange 96 with respect to the output gear 92 in the right direction (the direction of the coupling gear 95).

Mutually engaging mountain-valley shaped cams 95*d* and 96*d* are formed at opposing end portions of the coupling gear 95 and the coupling flange 96. Since the coupling flange 96 is biased by the coil spring 97 with respect to the output gear 92 in the right direction, the coupling flange 96 is biased so as to approach the coupling gear 95. Due to the biasing of the coupling flange 96, the cam 95*d* and the cam 96*d* mutually mesh and engage, thereby joining between the tubular shaft 95*a* of the coupling gear 95 and the shaft 96*a* of the coupling flange 96. When the coupling gear 95 rotates in this joined state, the coupling flange 96 rotates such that the output gear 92 also rotates following the rotation of the coupling flange 96.

Furthermore, as is also described later, with the rotational drive unit UN, in a state where an overload is exerted on the output gear 92, it becomes difficult for the coupling flange 96 and the output gear 92 to rotate. Thus, even though the coupling gear 95 and the cam 95*d* rotate, the coupling flange 96 and the cam 96*d* do not rotate, and the cam 95*d* and the cam 96*d* slip such the connection between the tubular shaft 95*a* of the coupling gear 95 and the shaft 96*a* of the coupling flange 96 is disjoined. In this disjoined state, the coupling flange 96 and the output gear 92 do not rotate and go into a stopped state.

In this way, the cam 95*d* of the coupling gear 95, the cam 96*d* of the coupling flange 96, and the coil spring 97 constitute the torque limiter.

As shown in FIG. 8, in the thus-configured rotational drive unit UN, the coupling flange 96 and the output gear 92 rotate together due to the engaging of the curved guide ribs 96*c* and the curved grooves 92*c*, and since the coil spring 97 is squeezed between the coupling flange 96 and the output gear 92, the coil spring 97 also rotates together with the coupling flange 96 and the output gear 92. For this reason, the biasing force of the coil spring 97 is maintained stably without twisting of the coil spring 97, and the overload on the output gear 92 is also stabilized when the cam 95*d* and the cam 96*d* slip such that the connection of the shafts 95*a* and 96*a* is disjoined.

In this regard, in the developer recovery device 71 according to the present embodiment, based on the on-off state of the switch 98 of the movable lever portion 91, determinations are performed as to the state of attachment/detachment of the toner recovery container 72 to the image forming apparatus 1, the full state in which the toner recovery container 72 is full of toner recovered in the developer recovery device 71, or a malfunction state of the developer recovery device 71.

Figure 9:
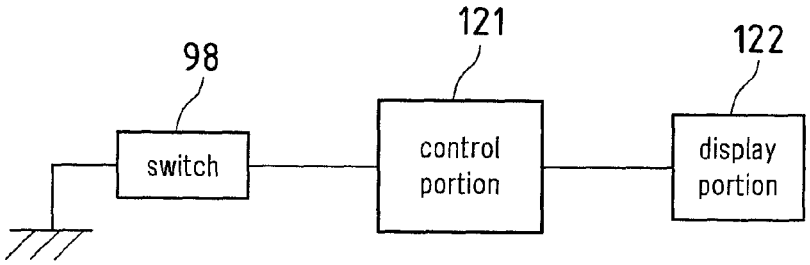
FIG. 9 is a block diagram showing a configuration of a control system that determines a state of attachment/detachment or a full state of the toner recovery container, or a malfunction state of the developer recovery device.

FIG. 9 is a block diagram showing a configuration of a control system that carries out determinations such as these. In FIG. 9, a control portion 121 monitors the on-off state of the switch 98 and, based on the on-off state of the switch 98, determines the state of attachment/detachment of the toner recovery container 72, the full state of the toner recovery container 72, or the malfunction state of the developer recovery device 71, and displays the determination result on a display portion 122.

Figure 10:
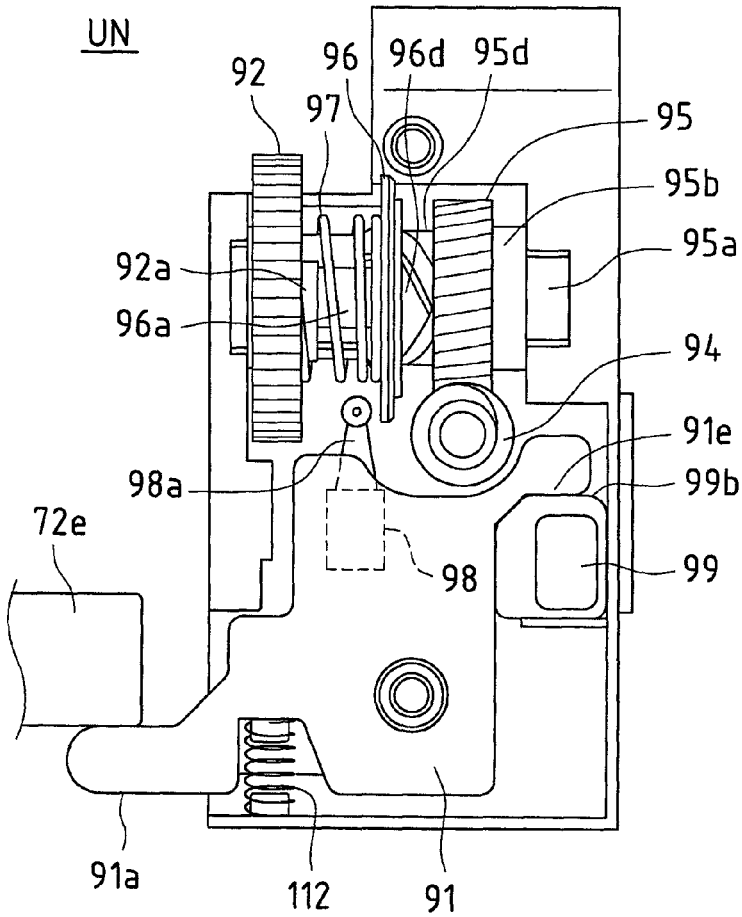
FIG. 10 is a front view showing the rotational drive unit when the toner recovery container is mounted.

First, when the toner recovery container 72 shown in FIG. 2 for example is arranged at a near side space inside the image forming apparatus 1 (see the dashed line region of reference symbol 71 shown in FIG. 1), the gear 85 that is secured to one end of the shaft 77*a* of the agitator blades 77 of the toner recovery container 72 meshes with the output gear 92 of the rotational drive unit UN. Furthermore, the protruding portion 72*e* of the bottom side right end of the lower side container 72-2 is placed on a lever 91*a* of the rotational drive unit UN, which is provided on the image forming apparatus 1 side, thereby pressing down on the lever 91*a*. That is, as shown in FIG. 10, the movable lever portion 91 rotates in a counterclockwise direction on the shaft 103*a* from the state shown in FIG. 7. At this time, due to the biasing force of the coil spring 113 (see FIG. 6), the knob 99 protrudes in the bias direction (in FIG. 10, toward the near side from the inner side of the paper plane), and a brim 99*b* of the knob 99 moves to the lower side of the engaging portion 91*e* of the movable lever portion 91. Due to this movement, the engaging portion 91*e* of the movable lever portion 91 engages with the brim 99*b*. That is, due to the brim 99*b* of the knob 99, the rotational position of the movable lever portion 91 is maintained. Due to the rotation of the movable lever portion 91, the movable piece 98*a* of the switch 98 provided for the movable lever portion 91 moves apart from the coupling flange 96 and displaces to the right direction (the moving apart direction away from the coupling flange 96), and the switch 98 changes from on to off.

And the control portion 121 deems that the toner recovery container 72 is mounted when the switch 98 changes from on to off and this off state of the switch 98 is maintained. Alternatively, the control portion 121 deems that the toner recovery container 72 is mounted when the switch 98 changes from on to off and this off state of the switch 98 is maintained during powering up of the image forming apparatus 1. At this time, the control portion 121 carries out control of displaying on the display portion 122 to the effect that the toner recovery container 72 is mounted.

In this state (a state in which the toner recovery container 72 is mounted in the image forming apparatus 1), when the image forming apparatus 1 operates, rotational drive from the drive source of the image forming apparatus 1 is transmitted to the input gear 93 of the rotational drive unit UN, and the input gear 93 is rotationally driven such that the worm gear 94 also rotates. Then, when the worm gear 94 rotates, the coupling gear 95 rotates. When rotation of the coupling gear 95 commences, since the cam 95*d* of the coupling gear 95 and the cam 96*d* of the coupling flange 96 are engaged, the coupling flange 96 and the output gear 92 rotate. The gear 85 of the agitator blades 77 that meshes with the output gear 92 rotates due to the rotation of the output gear 92 such that the agitator blades 77 rotate due to the rotation of the gear 85. Then, due to the rotation of the agitator blades 77, the toner that has dropped to the lower side container 72-2 of the toner recovery container 72 is agitated, thereby making uniform the height of the surface of the toner collected in the bottom of the lower side container 72-2.

Accordingly, the control portion 121 deems that the toner recovery container 72 is not in a full state when the off state of the switch 98 continues to be maintained.

Figure 11:
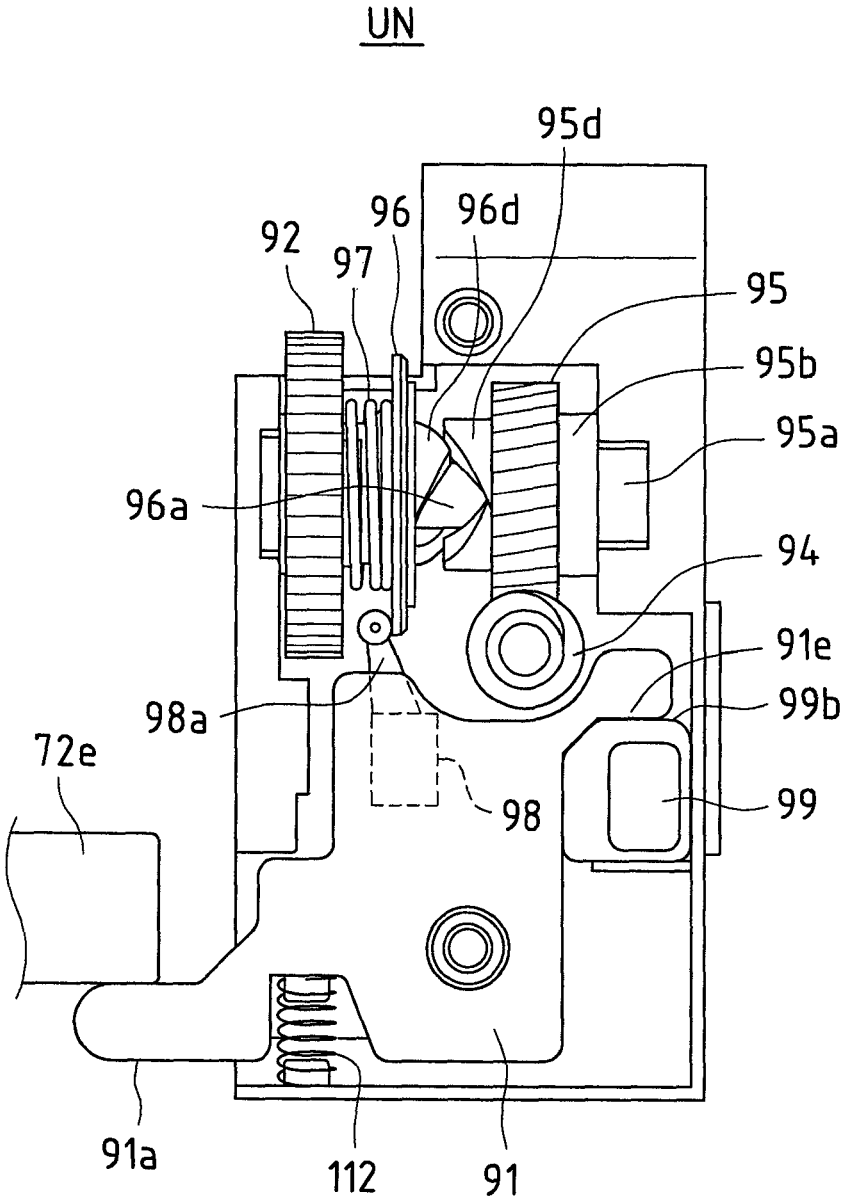
FIG. 11 is a front view of the rotational drive unit when the toner recovery container is mounted, and shows a disjoined state of the torque limiter.

Next, when the lower side container 72-2 of the toner recovery container 72 becomes full of toner, the agitator blades 77 become buried in toner and it becomes difficult for them to rotate such that an overload is exerted on the agitator blades 77. In this state, an overload is also exerted on the output gear 92 that meshes with the gear 85 of the agitator blades 77 such that it is difficult for the output gear 92 and the coupling flange 96 to rotate. At this time, as shown in FIG. 11, even though the coupling gear 95 and the cam 95*d* rotate, the coupling flange 96 and the cam 96*d* do not rotate, and the cam 95*d* and the cam 96*d* slip. Due to the slipping of the cam 95*d* and the cam 96*d*, the connection between the tubular shaft 95*a* of the coupling gear 95 and the shaft 96*a* of the coupling flange 96 is disjoined such that the coupling flange 96 and the output gear 92 stop rotation in cooperation with the coupling gear 95, and the coupling flange 96 and the output gear 92 go into a stopped state.

In a state where the coupling flange 96 has stopped due to the slipping of the cam 95*d* and the cam 96*d*, the mountain shape of the cam 95*d* and the mountain shape of the cam 96*d* repetitively slide in and out of contact in a periodic manner along with the rotation of the coupling gear 95. Each time this happens the coupling flange 96 moves in the left direction (the resistance direction with respect to the biasing force) in resistance to the biasing force of the coil spring 97, and the movable piece 98*a* of the switch 98 is pressed by the coupling flange 96 to be displaced to the left direction (resistance direction) such that the switch 98 turns on (see FIG. 11). Furthermore, in a state where the coupling flange 96 has stopped due to the slipping of the cam 95*d* and the cam 96*d*, not only do the mountain shape of the cam 95*d* and the mountain shape of the cam 96*d* repetitively slide in and out of contact, the mountain shape of the cam 95*d* and the valley shape of the cam 96*d*, and the valley shape of the cam 95*d* and the mountain shape of the cam 96*d* repetitively fit together in a periodic manner along with the rotation of the coupling gear 95. Each time this happens, the coupling flange 96 moves to the right direction (bias direction) due to the biasing force of the coil spring 97, and the movable piece 98*a* of the switch 98 moves apart from the coupling flange 96 and displaces to the right direction (bias direction) such that the switch 98 turns off (see FIG. 10). In this way, in a state where the coupling flange 96 has stopped due to the slipping of the cam 95*d* and the cam 96*d*, the cam 95*d* (the valley shape and mountain shape of the cam 95*d*) and the cam 96*d* (the valley shape and the mountain shape of the cam 96*d*) repetitively and alternately carry out moving out of contact and fitting together along with the rotation of the coupling gear 95.

Based on the on-off states of the switch 98 accompanying the rotation of the coupling gear 95 of the rotational drive unit UN, the control portion 121 determines the state in which the toner recovery container 72 has become full. With the developer recovery device 71, if the switch 98 periodically changes on/off accompanying rotation of the coupling gear 95, then it can be deemed there is a state in which the toner recovery container 72 has become full of toner.

Figure 12:
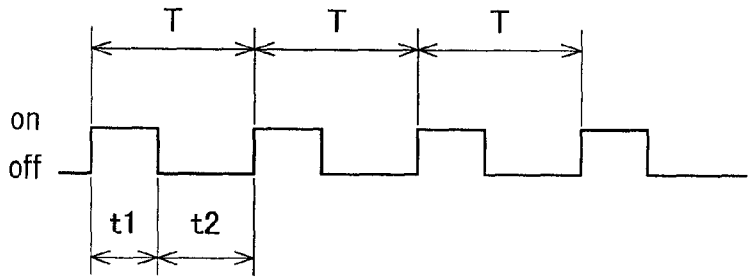
FIG. 12 is a timing chart showing on/off states of the switch when the toner recovery container in the rotational drive unit has become full of toner.

In more detail, suppose the switch 98 is changing on/off as shown in FIG. 12, the control portion 121 obtains an on time t1 in which the switch 98 is on and an off time t2 in which the switch 98 is off, then determines whether or not the on time t1 is within a first prescribed time range ta to taa that is set in advance, and determines whether or not the off time t2 is within a second prescribed time range tb to tbb that is set in advance. Then, if the on time t1 is within the first prescribed time range ta to taa (ta≤t1≤taa) and if the off time t2 is within the second prescribed time range tb to tbb (tb≤t2≤tbb), then it determines that there is a state in which the toner recovery container 72 has become full of toner. In this way, it can be accurately determined that the toner recovery container 72 is in a full state.

Here, when the toner recovery container 72 is not in a full state but is close to a full state, the load on the agitator blades 77 increases close to an overload such that the engagement state between the cam 95*d* of the coupling gear 95 and the cam 96*d* of the coupling flange 96 becomes unstable, and sometimes the switch 98 turns on and off irregularly. For this reason, there is a possibility of false determinations when determining if the recovery container 72 is in a full state based only on the on/off changing of the switch 98.

However, with the present embodiment, when the on time t1 of the switch 98 is within the first prescribed time range ta to taa (ta≤t1≤taa) and the off time t2 of the switch 98 is within the second prescribed time range tb to tbb (tb≤t2≤tbb), then it is determined that there is a state in which the toner recovery container 72 has become full of toner, and therefore there are no false determinations.

For example, when the engagement state between the cam 95*d* of the coupling gear 95 and the cam 96*d* of the coupling flange 96 becomes unstable, the on time or the off time of the switch 98 becomes too short or too long such that the on time t1 is outside the first prescribed time range ta to taa (t1<ta or taa<t1) or the off time t2 is outside the second prescribed time range tb to tbb (t2<tb or tbb<t2), and therefore it is not determined that the toner recovery container 72 is in a full state.

Alternatively, supposing the switch 98 changes on/off as shown in FIG. 12, the control portion 121 repetitively obtains an on/off period T of the switch 98, and determines whether or not this on/off period T is within a prescribed time range Tc to Tcc and whether or not it has repeated continuously for a prescribed number of times N (for example, N=3) or more. Then, if the on/off period T is within the prescribed time range Tc to Tcc (Tc≤T≤Tcc) and if the on/off periods within the prescribed time range Tc to Tcc have repeated continuously for three times or more, then it determines that there is a state in which the toner recovery container 72 has become full of toner. In this way, it can be accurately determined that the toner recovery container 72 is in a full state. It should be noted that in the present embodiment the prescribed number of times is set to three times, but the number of times may be set to five times for example and can be set arbitrarily.

In this case also there are no false determinations as to whether or not the toner recovery container 72 is in a full state. For example, when the engagement state between the cam 95*d* of the coupling gear 95 and the cam 96*d* of the coupling flange 96 becomes unstable, the on/off period T fluctuates wildly and is outside the prescribed time range Tc to Tcc (T<Tc or Tcc<T), and the on/off period T does not repeat three times or more within the prescribed time range Tc to Tcc, and therefore it is not determined that the toner recovery container 72 is in a full state.

When the control portion 121 determines that the toner recovery container 72 is in a full state in this manner, a message to the effect of prompting replacement of the toner recovery container 72 is displayed on the display portion 122. A user sees this display and replaces the toner recovery container 72 with a new container.

Next, with reference to FIG. 2, if the toner recovery container 72 has been removed for replacement, the protruding portion 72*e* at the bottom side right edge of the lower side container 72-2 comes away from the lever 91*a* of the rotational drive unit UN. Then, as shown in FIGS. 5 to 7, if the knob 99 is pressed, the movable lever portion 91 rotates in a clockwise direction until the engaging portion 91*e* of the movable lever portion 91 contacts the outer periphery of the knob 99 such that the lever 91*a* of the movable lever portion 91 rises up and the movable piece 98*a* of the switch 98 contacts the coupling flange 96 and displaces to the left direction, and the switch 98 turns on.

In this state, the coupling flange 96 does not move to the right direction regardless of whether the rotational drive unit UN is operating or stopped, and therefore the movable piece 98*a* of the switch 98 does not displace to the right direction and the on state of the switch 98 continues to be maintained.

Accordingly, in this case, if the on state of the switch 98 is maintained, it can be deemed that the toner recovery container 72 has been removed.

Figure 13:
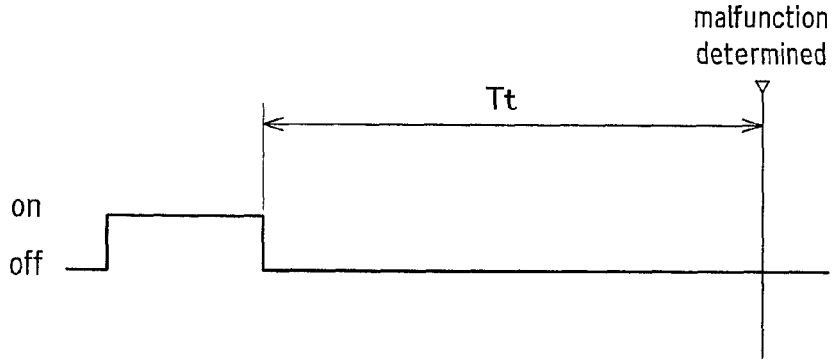
FIG. 13 is a timing chart showing on/off states of the switch when a malfunction has occurred in the developer recovery device.

Next, at a time when the input gear 93 of the rotational drive unit UN is rotating, if the switch 98 changes from off→on→off as shown in FIG. 13 and the off state after this change continues for no less than a malfunction determination time Tt that is set in advance, then the control portion 121 determines that a malfunction has occurred in the developer recovery device 71.

If the toner recovery container 72 is not in a full state, the cam 95*d* of the coupling gear 95 and the cam 96*d* of the coupling flange 96 are engaged and the agitator blades 77 continue to rotate, and therefore the switch 98 does not change. Furthermore, when the toner recovery container 72 becomes full, the cam 95*d* of the coupling gear 95 and the cam 96*d* of the coupling flange 96 slip such that the connection between the tubular shaft 95*a* of the coupling gear 95 and the shaft 96*a* of the coupling flange 96 disjoins and the switch 98 repetitively turns on and off, and therefore there is no long continuation of either the on or off state. Accordingly, at a time when the input gear 93 of the rotational drive unit UN is rotating, if the switch 98 changes from off→on→off and the off state after this change continues for no less than the malfunction determination time Tt, then it can be determined that a malfunction has occurred in the developer recovery device 71.

In this way, in the rotational drive unit UN of the developer recovery device according to the present embodiment, a torque limiter is provided in which the coil spring 97 is squeezed between the coupling flange (first rotation member) 96 and the output gear (second rotation member) 92, the coupling flange 96 is biased by the coil spring 97 in the right direction (the direction of the coupling gear 95) with respect to the output gear 92 such that the cam 96*d* of the coupling flange 96 and the cam 95*d* of the coupling gear 95 are caused to engage, and a connection is joined between the tubular shaft 95*a* of the coupling gear 95 and the shaft 96*a* of the coupling flange 96.

For this reason, if the lower side container 72-2 of the toner recovery container 72 is not full of toner and an overload is not exerted on the agitator blades 77, then the cam 96*d* of the coupling flange 96 and the cam 95*d* of the coupling gear 95 engage such that rotational force is transmitted in order from the coupling gear 95, to the coupling flange 96, to the output gear 92, and to the gear 95, thereby rotating the agitator blades 77. Furthermore, when the lower side container 72-2 becomes full of toner and an overload is exerted on the agitator blades 77, an overload is also exerted on the output gear 92 and the coupling flange 96 such that the cam 96*d* of the coupling flange 96 and the cam 95*d* of the coupling gear 95 slip resisting the biasing force of the coil spring 97, and the connection between the tubular shaft 95*a* of the coupling gear 95 and the shaft 96*a* of the coupling flange 96 disjoins, and the agitator blades 77 stop.

And in the present embodiment, the switch 98 is provided that turns on/off in response to the engaging and moving apart of the cam 96*d* of the coupling flange 96 and the cam 95*d* of the coupling gear 95, and based on the on-off state of the switch 98 it is determined whether or not the toner recovery container 72 is full of toner. That is, the switch 98 is provided that turns on/off in response to the engaging and moving apart of the cam 96*d* of the coupling flange 96 and the cam 95*d* of the coupling gear 95, the on time t1 in which the switch 98 is on and the off time t2 in which the switch 98 is off are obtained, and if the on time t1 is within the first prescribed time range ta to taa ($ta \le t1 \le taa$) and the off time t2 is within the second prescribed time range tb to tbb ($tb \le t2 \le tbb$), then it is determined that there is a state in which the toner recovery container 72 has become full of toner. Alternatively, if the on/period T is within the prescribed time range Tc to Tcc ($Tc \le T \le Tcc$) and if the on/off periods within the prescribed time range Tc to Tcc have repeated continuously for three times or more, then it determines that there is a state in which the toner recovery container 72 has become full of toner. Thus, it can be accurately determined that the toner recovery container 72 is in a full state.

Furthermore, at a time when the input gear 93 of the rotational drive unit UN is rotating, when the switch 98 changes from on to off and the off state after this change continues for no less than the malfunction determination time Tt, then it is determined that a malfunction has occurred in the developer recovery device 71.

Furthermore, the coupling flange 96 and the output gear 92 rotate together, and the coil spring 97 squeezed between the coupling flange 96 and the output gear 92 also rotates together, and therefore there is no twisting of the coil spring 97 and the biasing force of the coil spring 97 with respect to the coupling flange 96 is stabilized. For this reason, the overload on the output gear 92 and the agitator blades 77 is stabilized when the cam 96*d* of the coupling flange 96 and the cam 95*d* of the coupling gear 95 slip such that the connection between the cams 95*a* and 96*a* disjoins, and based on the on-off state of the switch 98, the determination of the full state of the lower side container 72-2 becomes accurate such that the replacements of the toner recovery container 72 can be carried out with appropriate timings.

Furthermore, no extra load is exerted on either the coupling flange 96 or the output gear 92 such that the durability of the device can be improved without causing wear to coupling flange 96 and the output gear 92.

The foregoing described preferable embodiments of the present invention with reference to the accompanying drawings, but the present invention is not limited to these examples. It is evident that a person skilled in the art would be capable of conceiving various modifications and alterations within the scope described by the claims, and naturally all of these are to be interpreted as belonging to the technical scope of the present invention.

For example, the relationship between the left-right displacement direction of the movable piece 98*a* of the switch 98 and the on-off state of the switch 98 may be reversed.

That is, the present invention can be embodied and practiced in other different forms without departing from the spirit, purport or essential characteristics thereof. Therefore, the above-described embodiments are considered in all respects as illustrative and not restrictive. The scope of the invention is indicated by the appended claims rather than by the foregoing description. All variations and modifications falling within the equivalency range of the appended claims are intended to be embraced therein.

What is claimed is:

1. A developer recovery device, comprising:

a recovery container that receives and accommodates a developer recovered from an image carrier, an agitator member that agitates the developer inside the recovery container, two shafts to which mutually engageable cams are respectively provided and that transmit rotational force to the agitator member, a spring that biases and causes to move one of the cams such that the two cams mutually engage and that causes a shaft connection between the two shafts to be joined, a torque limiter that carries out joining of the shaft connection, in which the two cams are caused to mutually engage to join the shaft connection, and disjoining of the shaft connection, in which the two cams are caused to move apart to disjoin the shaft connection, and a full-state determination portion that detects a disjoined state of the shaft connection and, based on the detected disjoined state, determines that the recovery container has become full of developer, wherein the torque limiter is constituted by the two cams and the spring, and in a disjoined state of the shaft connection, due to the torque limiter, the one cam is stopped and the other cam rotates such that the two cams repetitively engage and move apart, and the full-state determination portion is provided with a switch that is switched only between on and off in response to the engaging and moving apart of the two cams and obtains an on-off period of the switch, and in a case where the on-off period is within a prescribed time range that is set in advance and has been repeated at least a prescribed number of times that is set in advance, determines that the recovery container has become full of developer.

2. A developer recovery device, comprising:

a recovery container that receives and accommodates a developer recovered from an image carrier, an agitator member that agitates the developer inside the recovery container, two shafts to which mutually engageable cams are respectively provided and that transmit rotational force to the agitator member, a spring that biases and causes to move one of the cams such that the two cams mutually engage and that causes a shaft connection between the two shafts to be joined, a torque limiter that carries out joining of the shaft connection, in which the two cams are caused to mutually engage to join the shaft connection, and disjoining of the shaft connection, in which the two cams are caused to move apart to disjoin the shaft connection, and a full-state determination portion that detects a disjoined state of the shaft connection and, based on the detected disjoined state, determines that the recovery container has become full of developer, wherein the torque limiter is constituted by the two cams and the spring, and in a disjoined state of the shaft connection, due to the torque limiter, the one cam is stopped rotating and the other cam rotates such that the two cams repetitively engage and move apart, and the full-state determination portion is provided with a switch that is switched only between on and off in response to the engaging and moving apart of the cams, obtains an on time of the switch and an off time of the switch, and in a case where the on time is within a first prescribed time range that is set in advance and the off time is within a second prescribed time range that is set in advance, determines that the recovery container has become full of developer.

3. The developer recovery device according to claim 1, wherein the full-state determination portion, in rotationally driving the agitator member, when the switch changes to on or off and the on/off state after the change continues for at least a malfunction determination time that is set in advance, determines that a malfunction has occurred.

4. The developer recovery device according to claim 2, wherein the full-state determination portion, in rotationally driving the agitator member, when the switch changes to on or off and the on/off state after the change continues for at least a malfunction determination time that is set in advance, determines that a malfunction has occurred.

5. The developer recovery device according to claim 1, wherein the torque limiter comprises a second rotation member that is integrally secured to the one cam and that rotates and moves together with the one cam, and the switch turns on/off by detecting a position of the second rotation member.

6. The developer recovery device according to claim 2, wherein the torque limiter comprises a second rotation member that is integrally secured to the one cam and that rotates and moves together with the one cam, and the switch turns on/off by detecting a position of the second rotation member.

7. The developer recovery device according to claim 5, wherein the second rotation member is a gear and the gear meshes with a gear provided on a shaft of the agitator member.

8. The developer recovery device according to claim 6, wherein the second rotation member is a gear and the gear meshes with a gear provided on a shaft of the agitator member.

9. A developer recovery device, comprising:

a recovery container that receives and accommodates a developer recovered from an image carrier, an agitator member that agitates the developer inside the recovery container, two shafts to which mutually engageable cams are respectively provided and that transmit rotational force to the agitator member, a first rotation member that is integrally secured to the one cam and that rotates together with the one cam, a second rotation member that is positioned along a shaft of the first rotation member, which is provided with the one cam, and that rotates together with the one cam, a spring that is interposed between the first rotation member and the second rotation member, that biases and causes to move the one cam such that the two cams mutually engage, and that causes a shaft connection between the two shafts to be joined, a torque limiter that includes the two cams and the spring, and that carries out joining of the shaft connection, in which the two cams are caused to mutually engage to join the shaft connection, and disjoining of the shaft connection, in which the two cams are caused to move apart to disjoin the shaft connection, and a full-state determination portion is provided with a switch that is switched only between on and off that detects a disjoined state of the shaft connection and, based on the detected disjoined state, determines that the recovery container has become full of developer.

10. The developer recovery device according to claim 9, wherein the second rotation member is a gear and the gear meshes with a gear provided on a shaft of the agitator member.

11. The developer recovery device according to claim 9, wherein when a position of the first rotation member is detected at a time when the cams have slipped resisting the biasing force of the spring and the shaft connection has become disjoined, the full-state determination portion determines that the recovery container has become full of developer.

12. The developer recovery device according to claim 9, wherein a shaft of the first rotation member is provided with a claw, and a rib is formed in the first rotation member, a hole is provided and a groove is formed in the second rotation member, the shaft of the first rotation member is inserted into the hole of the second rotation member so as to be movable, the claw of the shaft of the first rotation member catches onto a peripheral edge of the hole of the second rotation member, and the rib of the first rotation member engages with the groove of the second rotation member such that the first rotation member and the second rotation member rotate together.

13. The developer recovery device according to claim 9, wherein the spring is a coil spring into which the shaft of the first rotation member is inserted.

14. An image forming apparatus comprising a developer recovery device according to claim 1.

15. An image forming apparatus comprising a developer recovery device according to claim 2.

16. An image forming apparatus comprising a developer recovery device according to claim 9.

17. The developer recovery device according to claim 1, wherein the switch is turned off when the developer recovery device is mounted on an image forming apparatus, and the switch is turned on when the developer recovery device is removed from the image forming apparatus.

18. The developer recovery device according to claim 2, wherein the switch is turned off when the developer recovery device is mounted on an image forming apparatus, and the switch is turned on when the developer recovery device is removed from the image forming apparatus.

* * * * *